US011690162B2

(12) United States Patent
Bezel et al.

(10) Patent No.: US 11,690,162 B2
(45) Date of Patent: Jun. 27, 2023

(54) LASER-SUSTAINED PLASMA LIGHT SOURCE WITH GAS VORTEX FLOW

(71) Applicant: KLA Corporation, Milpitas, CA (US)

(72) Inventors: Ilya Bezel, Mountain View, CA (US); Andrey Evgenievich Stepanov, Moscow (RU); Leonid Borisovich Zvedenuk, Moscow (RU); Yuriy Gennadievich Kutsenko, Moscow (RU); Boris Vasilyevich Potapkin, Moscow (RU); Sumeet Kumar, San Jose, CA (US)

(73) Assignee: KLA Corporation, Milpitas, CA (US)

( * ) Notice: Subject to any disclaimer, the term of this patent is extended or adjusted under 35 U.S.C. 154(b) by 149 days.

(21) Appl. No.: 17/223,942

(22) Filed: Apr. 6, 2021

(65) Prior Publication Data

US 2021/0321508 A1 Oct. 14, 2021

Related U.S. Application Data

(60) Provisional application No. 63/008,840, filed on Apr. 13, 2020.

(51) Int. Cl.
*H05H 1/46* (2006.01)

(52) U.S. Cl.
CPC ..... *H05H 1/46* (2013.01)

(58) Field of Classification Search
CPC ..... H01J 47/002; H01J 47/026; H01J 61/12; H01J 61/16; H01J 61/30; H01J 61/36;
(Continued)

(56) References Cited

U.S. PATENT DOCUMENTS 4,179,599 A 12/1979 Conrad
5,608,526 A 3/1997 Piwonka-Corle et al.
(Continued)

FOREIGN PATENT DOCUMENTS

EP 1797746 A2 6/2007
JP 2004134363 A 4/2004

OTHER PUBLICATIONS

Chiranjeev Kalra et al., Electrical discharges in the Reverse Vortex Flow—Tornado Discharges, Jan. 2003, https://www.researchgate.net/publication/240635026_Electrical_discharges_in_the_Reverse_Vortex_Flow_-_Tornado_Discharges, 7 pages.
(Continued)

*Primary Examiner* — Abdullah A Riyami
*Assistant Examiner* — Syed M Kaiser
(74) *Attorney, Agent, or Firm* — Suiter Swantz pc llo

(57) ABSTRACT

A laser-sustained plasma (LSP) light source with vortex gas flow is disclosed. The LSP source includes a gas containment structure for containing a gas, one or more gas inlets configured to flow gas into the gas containment structure, and one or more gas outlets configured to flow gas out of the gas containment structure. The one or more gas inlets and the one or more gas outlets are arranged to generate a vortex gas flow within the gas containment structure. The LSP source also includes a laser pump source configured to generate an optical pump to sustain a plasma in a region of the gas containment structure within an inner gas flow within the vortex gas flow. The LSP source includes a light collector element configured to collect at least a portion of broadband light emitted from the plasma.

29 Claims, 15 Drawing Sheets

(58) Field of Classification Search
CPC .. H01J 61/52; H01J 61/54; H01J 63/02; H01J 65/04; H05H 1/46
See application file for complete search history.

(56) References Cited

U.S. PATENT DOCUMENTS

| | | | | |
|---|---|---|---|---|
| 5,837,958 | A * | 11/1998 | Fornsel | H05H 1/34 313/231.51 |
| 5,999,310 | A | 12/1999 | Shafer et al. | |
| 6,297,880 | B1 | 10/2001 | Rosencwaig et al. | |
| 7,345,825 | B2 | 3/2008 | Chuang et al. | |
| 7,435,982 | B2 | 10/2008 | Smith | |
| 7,525,649 | B1 | 4/2009 | Leong et al. | |
| 7,786,455 | B2 | 8/2010 | Smith | |
| 7,957,066 | B2 | 6/2011 | Armstrong et al. | |
| 7,989,786 | B2 | 8/2011 | Smith et al. | |
| 8,182,127 | B2 | 5/2012 | Yasuda et al. | |
| 8,309,943 | B2 | 11/2012 | Smith et al. | |
| 8,525,138 | B2 | 9/2013 | Smith et al. | |
| 8,921,814 | B2 | 12/2014 | Pellemans et al. | |
| 9,099,292 | B1 | 8/2015 | Bezel et al. | |
| 9,185,788 | B2 | 11/2015 | Bezel et al. | |
| 9,228,943 | B2 | 1/2016 | Wang et al. | |
| 9,263,238 | B2 | 2/2016 | Wilson et al. | |
| 9,318,311 | B2 | 4/2016 | Chimmalgi et al. | |
| 9,390,902 | B2 | 7/2016 | Bezel et al. | |
| 9,721,761 | B2 | 8/2017 | Wilson et al. | |
| 9,775,226 | B1 | 9/2017 | Bezel et al. | |
| 10,690,589 | B2 | 6/2020 | Bezel et al. | |
| 2003/0222586 | A1 | 12/2003 | Brooks et al. | |
| 2009/0057567 | A1* | 3/2009 | Bykanov | H05G 2/005 422/186.04 |
| 2009/0068598 | A1* | 3/2009 | Murase | B23K 26/0732 430/311 |
| 2014/0159572 | A1 | 6/2014 | Risby et al. | |
| 2016/0000499 | A1* | 1/2016 | Lennox | A61N 7/022 606/41 |
| 2017/0345639 | A1 | 11/2017 | Bezel et al. | |
| 2019/0033204 | A1 | 1/2019 | Bezel et al. | |
| 2020/0403555 | A1* | 12/2020 | Mills | G21B 3/004 |
| 2021/0245133 | A1* | 8/2021 | Soane | B01J 19/126 |
| 2021/0321508 | A1* | 10/2021 | Bezel | H05H 1/46 |

OTHER PUBLICATIONS

M.V. Gerasimenko et al., CW optical discharge in the laser-plasmatron mode, Pisma v Zhurnal Tekhnischeskoi Fiziki, vol. 5, Aug. 12, 1979, p. 954-957.) Soviet Technical Physics Letters, vol. 5, Aug. 1979, p. 397, 398.

Y.D. Korolev, et al., Nonsteady-State Processes in a Plasma Pilot for Ignition and Flame Control, Special Issue of the IEEE Transactions on Plasma Science "Plasma-Assisted Combustion", Jan. 2007, IEEE, 7 pages.

Raizer, Y. P. (1991). Gas discharge physics. Berlin: Springer-Verlag, pp. 306-323.

PCT International Search Report and Written Opinion for International Application No. PCT/US2021/026936 dated Aug. 6, 2021, 8 pages.

* cited by examiner

200

300

LASER-SUSTAINED PLASMA LIGHT SOURCE WITH GAS VORTEX FLOW

CROSS-REFERENCE TO RELATED APPLICATION

The present application claims the benefit under 35 U.S.C. § 119(e) of U.S. Provisional Application Ser. No. 63/008,840, filed Apr. 13, 2020, which is incorporated herein by reference in the entirety.

TECHNICAL FIELD

The present invention generally relates to a laser sustained plasma (LSP) broadband light source and, in particular, an LSP source including gas vortex flow to organize through the LSP region of the LSP source.

BACKGROUND

The need for improved light sources used for inspection of ever-shrinking semiconductor devices continues to grow. One such light source includes a laser sustained plasma (LSP) broadband light source. LSP broadband light sources include LSP lamps, which are capable of producing high-power broadband light. The gas in the vessel is typically stagnant as most current LSP lamps do not have any mechanisms for forcing gas flow through the lamp except for natural convection caused by the buoyancy of hot plasma plume. Previous attempts at flowing gas through LSP lamps have resulted in instabilities within the LSP lamp caused by unsteady turbulent gas flow. These instabilities are amplified at higher power and at locations of mechanical elements (e.g., nozzles), whereby high radiative thermal load on these mechanical elements is created, resulting in overheating and melting. As such, it would be advantageous to provide a system and method to remedy the shortcomings of the previous approaches identified above.

SUMMARY

A laser-sustained plasma (LSP) light source is disclosed. In an illustrative embodiment, the LSP source includes a gas containment structure for containing a gas. In another illustrative embodiment, the LSP source includes one or more gas inlets fluidically coupled to the gas containment structure and configured to flow the gas into the gas containment structure. In another illustrative embodiment, the LSP source includes one or more gas outlets fluidically coupled to the gas containment structure and configured to flow gas out of the gas containment structure, wherein the one or more gas inlets and the one or more gas outlets are arranged to generate a vortex gas flow within the gas containment structure. In another illustrative embodiment, the LSP source includes a laser pump source configured to generate an optical pump to sustain a plasma in a region of the gas containment structure within an inner gas flow within the vortex gas flow. In another illustrative embodiment, the LSP source includes a light collector element configured to collect at least a portion of broadband light emitted from the plasma.

In another illustrative embodiment, the one or more gas inlets and the one or more gas outlets are arranged to generate a vortex gas flow within the gas containment structure such that the vortex gas flow direction through the plasma region is in the same direction (i.e., flow-through vortex flow) of an inlet gas flow from the one or more inlets.

In another illustrative embodiment, the one or more gas inlets and the one or more gas outlets are arranged to generate a vortex gas flow within the gas containment structure such that the vortex gas flow direction through the plasma region is in the opposite direction (i.e., reverse vortex flow) of an inlet gas flow from the one or more inlets.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Figure 1:
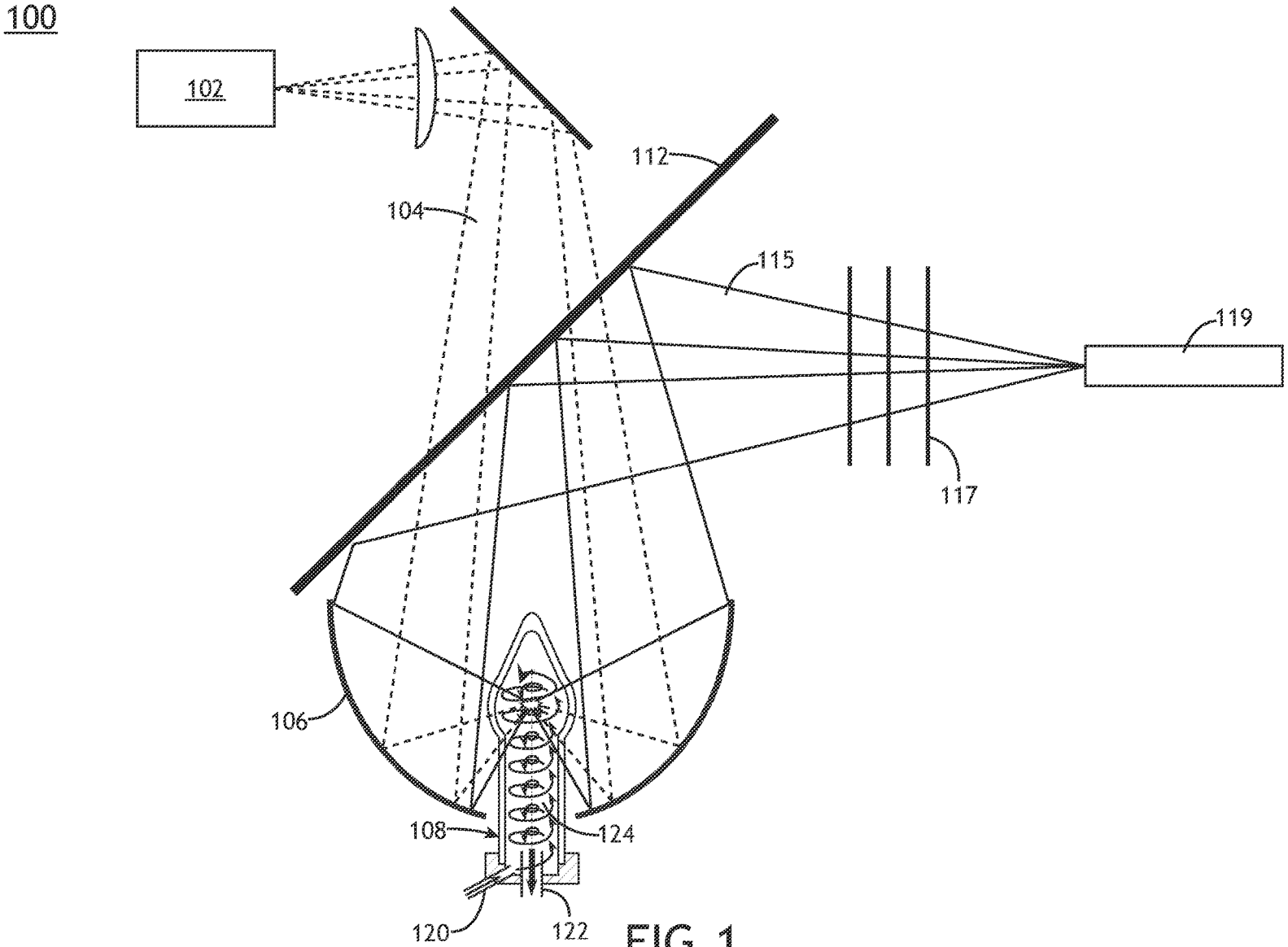
FIG. 1 is a schematic illustration of an LSP broadband light source, in accordance with one or more embodiments of the present disclosure.

The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure. Reference will now be made in detail to the subject matter disclosed, which is illustrated in the accompanying drawings.

Embodiments of the present disclosure are directed to an LSP light source implementing vortex flow or reverse vortex flow to organize gas flow through the LSP region of the LSP light source. Embodiments of the disclosure are directed to a transparent bulb, cell, or chamber used to contain high-pressure gas needed for LSP operation, gas inlet jet(s), and gas outlet(s) used to produce the vortex gas flow or reverse vortex gas flow. In one embodiment, the inlets and outlets are positioned on opposite sides of a cell forcing the same overall direction of the gas flow. In another embodiment, the inlets and outlets are positioned on the same side of the cell, which forms a reverse vortex flow pattern, with the general direction of the flow changing inside the cell.

Embodiments for the present disclosure may be used to form two gas flow regions—an outer region located near the cell walls and an inner region located near the cell central axis. The LSP may be sustained in a central location near the symmetry axis of the cell and is subject to be affected by the inner part of the flow. There are various advantages to the configuration of the present disclosure. For example, fast gas flow is created through the plasma region that results in a smaller plasma size and, therefore, a higher plasma brightness. The hot plume emerging from the plasma is removed from the pump laser propagation path and does not create "air wiggle" aberrations thus resulting in more stable plasma operation. Gas flow is stabilized in a vortex arrangement allowing for more stable plasma operation. The hot plasma plume is kept way from the cell walls, which reduces the thermal heat load on the walls and allow for the use optical materials that are sensitive to overheating. The separation of the inner and outer flows allows for cell wall cooling, creating favorable photochemical environment, and radiation blocking.

The generation of a light-sustained plasma is also generally described in U.S. Pat. No. 7,435,982, issued on Oct. 14, 2008, which is incorporated by reference herein in the entirety. The generation of plasma is also generally described in U.S. Pat. No. 7,786,455, issued on Aug. 31, 2010, which is incorporated by reference herein in the entirety. The generation of plasma is also generally described in U.S. Pat. No. 7,989,786, issued on Aug. 2, 2011, which is incorporated by reference herein in the entirety. The generation of plasma is also generally described in U.S. Pat. No. 8,182,127, issued on May 22, 2012, which is incorporated by reference herein in the entirety. The generation of plasma is also generally described in U.S. Pat. No. 8,309,943, issued on Nov. 13, 2012, which is incorporated by reference herein in the entirety. The generation of plasma is also generally described in U.S. Pat. No. 8,525,138, issued on Feb. 9, 2013, which is incorporated by reference herein in the entirety. The generation of plasma is also generally described in U.S. Pat. No. 8,921,814, issued on Dec. 30, 2014, which is incorporated by reference herein in the entirety. The generation of plasma is also generally described in U.S. Pat. No. 9,318,311, issued on Apr. 19, 2016, which is incorporated by reference herein in the entirety. The generation of plasma is also generally described in U.S. Pat. No. 9,390,902, issued on Jul. 12, 2016, which is incorporated by reference herein in the entirety. In a general sense, the various embodiments of the present disclosure should be interpreted to extend to any plasma-based light source known in the art.

FIG. 1 is a schematic illustration of an LSP light source 100 with vortex flow, in accordance with one or more embodiments of the present disclosure. The LSP source 100 includes a pump source 102 configured to generate an optical pump 104 for sustaining a plasma 110. For example, the pump source 102 may emit a beam of laser illumination suitable for pumping the plasma 110. In embodiments, the light collector element 106 is configured to direct a portion of the optical pump 104 to a gas contained in the vortex-producing gas containment structure 108 to ignite and/or sustain a plasma 110. The pump source 102 may include any pump source known in the art suitable for igniting and/or sustaining plasma. For example, the pump source 102 may include one or more lasers (i.e., pump lasers). The pump beam may include radiation of any wavelength or wavelength range known in the art including, but not limited to, visible, IR radiation, NIR radiation, and/or UV radiation The light collector element 106 is configured to collect a portion of broadband light 115 emitted from the plasma 110. The gas containment structure 108 may include one or more gas inlets 120 and one or more gas outlets 122, which are arranged to form a vortex gas flow 124 within the interior of the gas containment structure 108. The broadband light 115 emitted from the plasma 110 may be collected via one or more additional optics (e.g., a cold mirror 112) for use in one or more downstream applications (e.g., inspection, metrology, or lithography). The LSP light source 100 may include any number of additional optical elements such as, but not limited to, a filter 117 or a homogenizer 119 for conditioning the broadband light 115 prior to the one or more downstream applications. The gas containment structure 108 may include a plasma cell, a plasma bulb (or lamp), or a plasma chamber.

Figure 2:
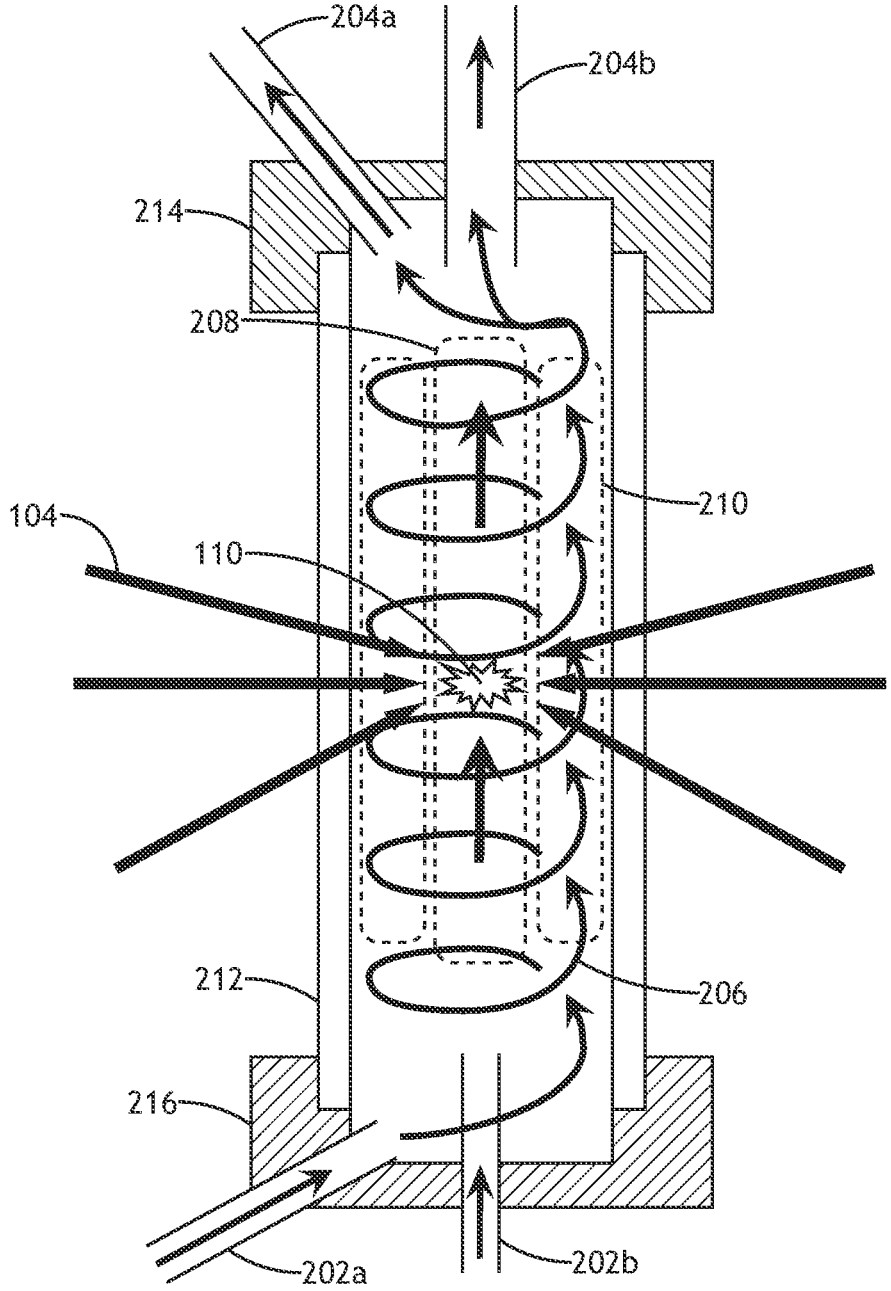
FIG. 2 is a schematic illustration of a vortex-generating gas cell for use in the LSP broadband light source, in accordance with one or more embodiments of the present disclosure.

FIG. 2 illustrates a simplified schematic view of a vortex cell 200 suitable for use as the vortex-producing gas containment structure 108, in accordance with one or more embodiments of the present disclosure. In embodiments, the vortex cell 200 includes one or more gas inlets configured to flow the gas into the vortex cell 200 and one or more gas outlets configured to configured to flow gas out of the vortex cell 200. For example, the vortex cell 200 includes a first gas inlet 202*a* located at a peripheral location (e.g., bottom corner) of the vortex cell 200 and a second gas inlet 202*b* located at a center location (e.g., bottom center) of the vortex cell 200. The vortex cell 200 also includes a first gas outlet 204*a* located at a peripheral location (e.g., top corner) of the vortex cell 200 and a second gas outlet 204*b* located at a center location (e.g., top center) of the vortex cell 200. In embodiments, the one or more gas inlets and the one or more first gas outlets are arranged to generate a vortex flow 206 within the vortex cell 200. In this embodiment, the inlets 202*a*, 202*b* are located on one side (e.g., bottom side) of the vortex cell 200 and the outlets 204*a*, 204*bb* are located on the opposite side (e.g., top side) of the vortex cell 200, which ensures unidirectional vortex motion of gas through the vortex cell 200.

In embodiments, the vortex flow is a helical vortex flow with a drift velocity between 1-100 m/s at locations near the plasma 110. It is noted that the tangential velocities within the gas may exceed the drift velocity by several factors. The vortex gas flow 206 of the vortex cell 200 includes an inner flow region 208 and an outer flow region 210. In this embodiment, the vortex cell 200 serves as a flow-through vortex cell, whereby inner gas flow 208 flows in the same direction as the outer gas flow 210 (upward in FIG. 2). In this regard, the direction of the vortex gas flow through the plasma region may be in the same direction as the inlet gas flow from the one or more inlets. In embodiments, the pump source 102 directs the optical pump illumination 104 to a central region of the vortex cell 200 such that the pump illumination is subject to the inner flow region 208. The separation of the inner flow 208 and outer flow 210 allows for cell wall cooling, creating favorable photochemical environment, and radiation blocking.

The vortex cell 200 includes an optical transmission element 106 configured for containing the plasma-forming gas and transmitting optical pump illumination 104 and broadband light 115. For example, the transparent wall 212 may include a cylinder formed from a material transparent to at least a portion of the pump illumination 104 and the broadband light 115. The transparent optical element 106 of the vortex cell 200 can be formed from any number of different optical materials. For example, the optical transmission element 106 may be formed from, but is not limited to, sapphire, crystal quartz, $CaF_2$, $MgF_2$, or fused silica. It is noted that the vortex flow 206 of the vortex cell 200 keeps the hot plume of the plasma 110 from the walls of the vortex cell 200, which reduces the thermal head load on the walls and allows for the use of optical materials sensitive to overheating (e.g., glass, CaF2, MgF2, crystal quartz, and the like).

Figure 3:
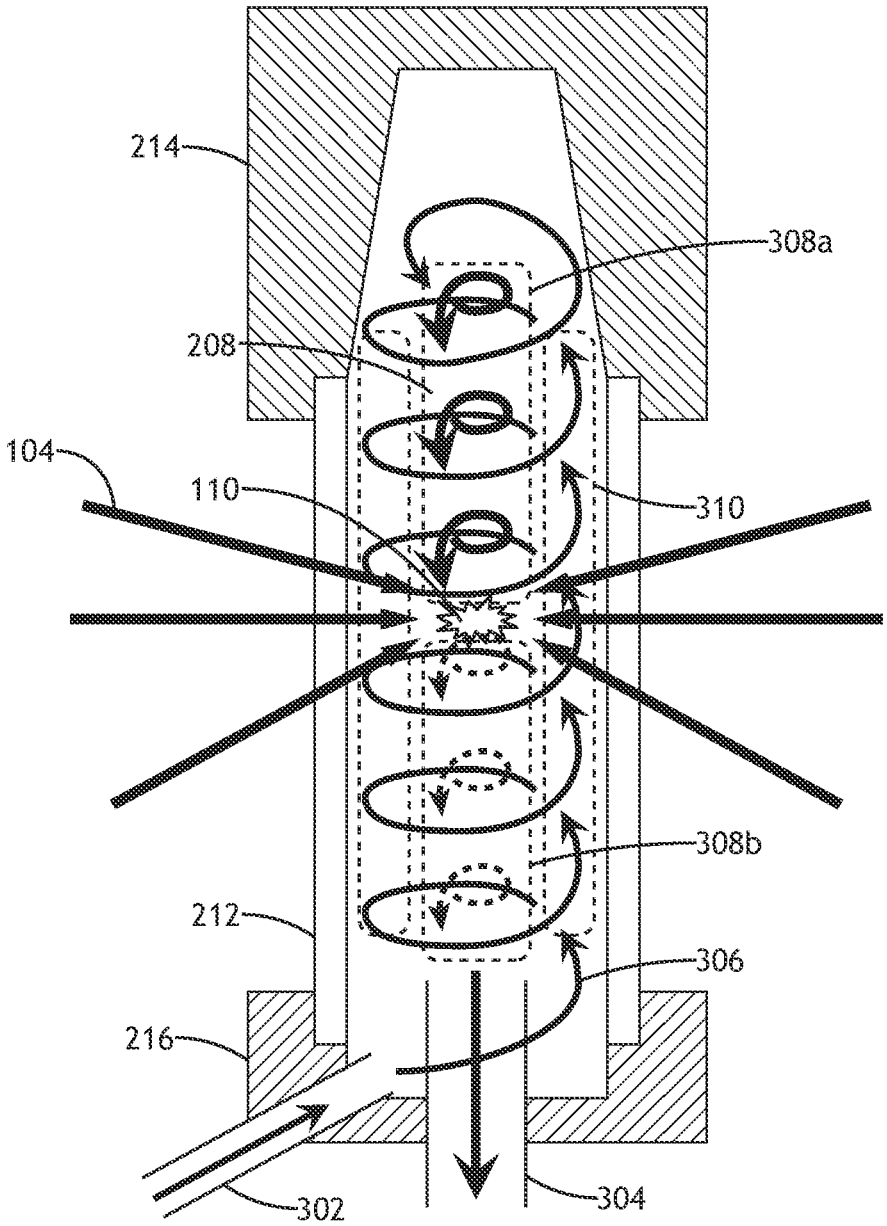
FIG. 3 is a schematic illustration of a reverse-flow vortex-generating gas cell for use in the LSP broadband light source, in accordance with one or more embodiments of the present disclosure.

In embodiments, the vortex cell 200 includes one or more flanges for terminating/sealing the transparent optical element 106. For example, the vortex cell 200 may include, but is not limited to, a top flange 214 and a bottom flange 216. In embodiments, the top and/or bottom flanges 214, 216 may secure inlet and/or outlet pipes or tubes and additional mechanical and electronic components. The use of a flanged plasma cell is described in at least U.S. Pat. No. 9,775,226, issued on Sep. 26, 2017; and U.S. Pat. No. 9,185,788, issued on Nov. 10, 2015, which are each incorporated previously herein by reference in the entirety FIG. 3 illustrates a simplified schematic view of a reverse-flow vortex cell 300 suitable for use as the vortex-producing gas containment structure 108, in accordance with one or more embodiments of the present disclosure. It is noted that the description associated with FIG. 2 should be interpreted to extend to the embodiments of FIG. 3 unless otherwise noted. In embodiments, the reverse-flow vortex cell 300 includes a gas inlet 302 and a gas outlet 304. In addition, the reverse-flow vortex cell 300 includes a bottom flange 216 and a top flange 214. In this example, the top flange 214 may include a blind flange or cap.

In this embodiment, the vortex cell 300 is arranged in a reverse-flow configuration. In the reverse vortex configuration, the outer vortex flow 310 propagates in the direction opposite to the inner vortex flow 308*a*, 308*b*. The reverse-flow configuration may be generated by placement of the gas inlet 302 on the same side (e.g., bottom) of the reverse-flow vortex cell 300 as the gas outlet 304. In addition, the gas inlet 302 may be positioned at the periphery, or side, of the bottom flange 216, which assists in creating vorticity in the gas flow of the cell 300. In this embodiment, the vortex gas flow moves upward at the periphery of the vortex cell 300. Then, the narrowing cavity of the top flange 316 acts to roll the outer vortex flow 310 back down into the center region of the vortex cell 300. As gas is continually flowed through the vortex cell 300 this creates an outer vortex region 310 moving upward and an inner vortex region 308*a*,308*b* moving downward through the outer vortex region 310. In this arrangement, the top inner vortex flow 308*a* is directed toward the plasma 110, with the bottom inner vortex flow 308*b* carrying the plume of the plasma 110 downward. In this regard, the direction of the vortex gas flow through the plasma region may be in the opposite direction as the inlet gas flow from the one or more inlets.

Figure 4B:
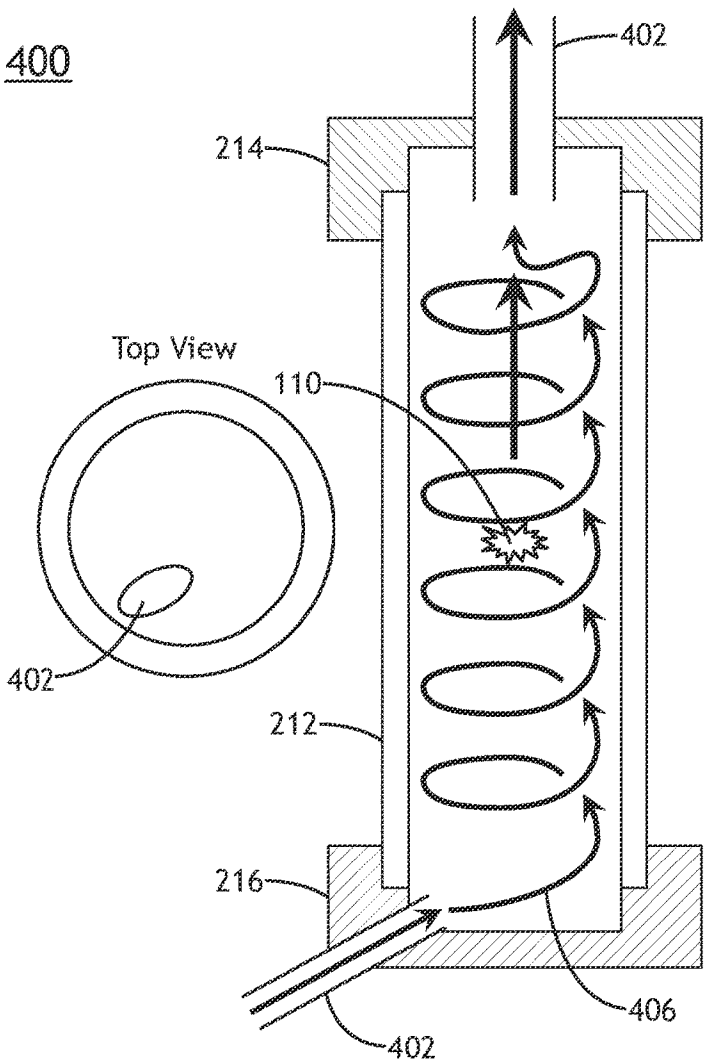
FIGS. 4A and 4B are schematic illustrations of a single-inlet vortex-generating gas cell for use in the LSP broadband light source, in accordance with one or more embodiments of the present disclosure.
Figure 4A:
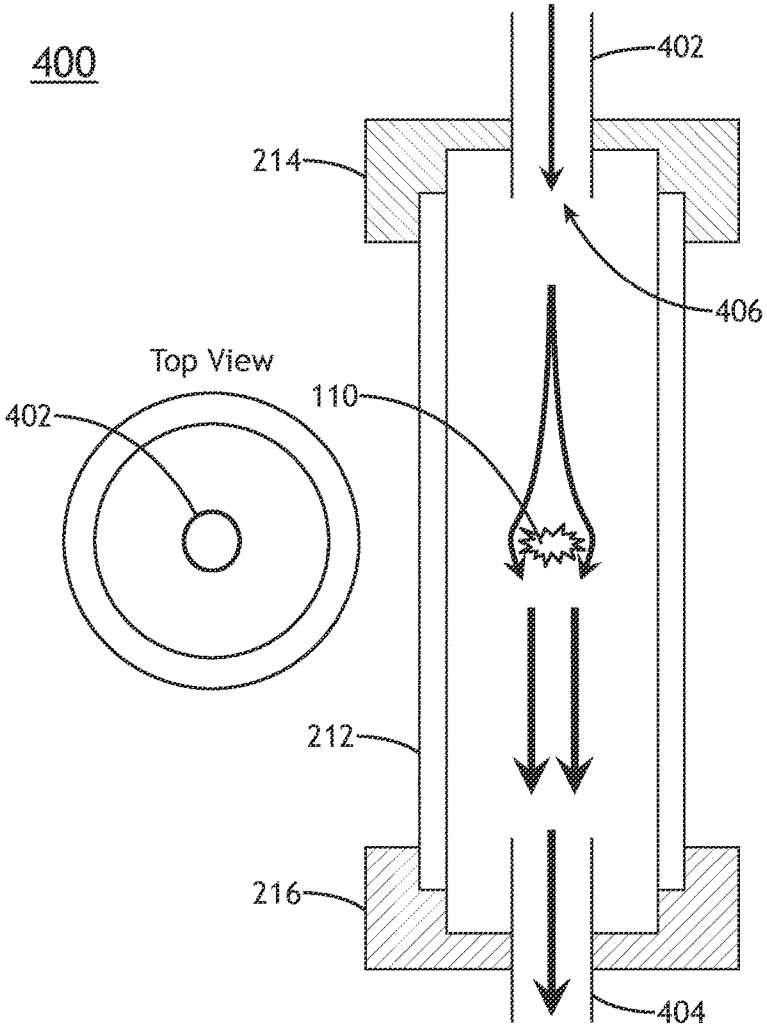

FIG. 4A illustrates a simplified schematic view of a single-inlet vortex cell 400 suitable for use as the vortex-producing gas containment structure 108, in accordance with one or more embodiments of the present disclosure. In this embodiment, a single centrally-located inlet 402 and an outlet 404 are utilized to create a fast gas flow (e.g., 1-100 m/s) through the plasma-forming region of the vortex cell 400. Due to the central location of the single inlet 402 and outlet 404, the gas flow has relatively minimal vorticity. In other embodiments, as shown in FIG. 4B, the single inlet 402 is located at a peripheral location (e.g., edge) of the cell 410 and directed at an oblique angle into the cell and is utilized to create a fast high-vorticity gas flow (e.g., 1-100 m/s) through the plasma-forming region of the vortex cell 400. Due to the peripheral location of the single inlet 402 and the central location of the single outlet 404, the gas flow has relatively high vorticity.

Figure 4C:
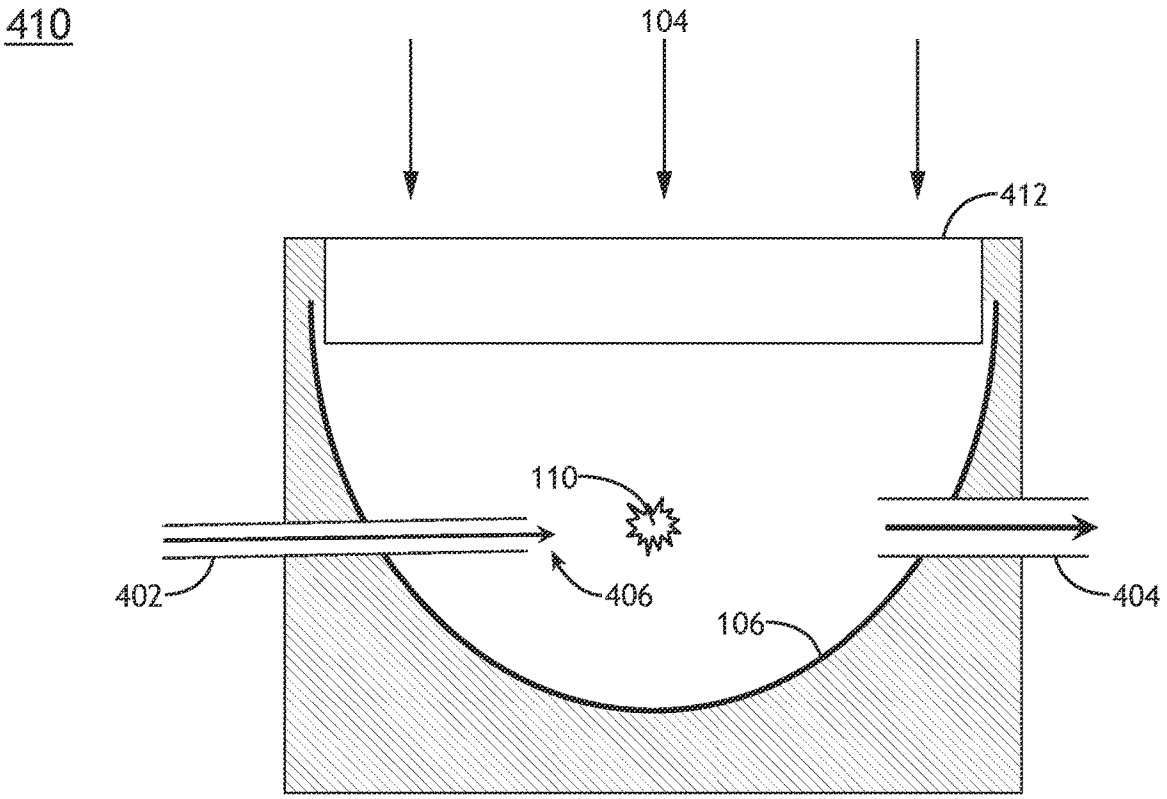
FIG. 4C is a schematic illustration of a single-inlet vortex-generating gas chamber for use in the LSP broadband light source, in accordance with one or more embodiments of the present disclosure.

FIG. 4C illustrates a simplified schematic view of a single-inlet vortex chamber 410 suitable for use as the vortex-producing gas containment structure 108, in accordance with one or more embodiments of the present disclosure. In this embodiment, the plasma cell as shown in FIG. 1 may be replaced with the plasma chamber 410. It is noted that the embodiments described previously herein with respect to FIGS. 1 through 4B should be interpreted to extend to the embodiment of FIG. 4C unless otherwise noted. The use of a gas chamber as a gas containment structure is described in U.S. Pat. No. 9,099,292, issued on Aug. 4, 2015; U.S. Pat. No. 9,263,238, issued on Feb. 16, 2016; U.S. Pat. No. 9,390,902, issued on Jul. 12, 2016, which are each incorporated herein by reference in their entirety.

In this embodiment, the light collector element 106, along with the window 412, may be configured to form the gas containment structure. For example, the light collector element 106 may be sealed with the window 412 so to contain the gas within the volume defined by the surfaces of the light collector element 106 and window 412. In this example, an internal gas containment structure, such as plasma cell or plasma bulb is not needed, with the surfaces of the light collector element 106 and one or more windows 412 forming the plasma chamber 410. In this case, the opening of the light collector element 106 may be sealed with the window 412 (e.g., glass window) to allow both the pump illumination 104 and plasma broadband light 115 to pass through it.

In embodiments, the plasma chamber 410 includes a single inlet 402 and an outlet 404. The single inlet 402 and outlet 404 are utilized to create a fast gas flow (e.g., 1-20 m/s) through the plasma-forming region of the vortex chamber 410. Due to the alignment of the single inlet 402 and outlet 404, the gas flow has relatively minimal vorticity. It is noted that the inlet 402 and outlet 404 may be positioned along any portion of the light collector element 106. It is noted that any nozzle configuration of the present disclosure, as discussed further herein, may be used in the inlet 402 of FIGS. 4A-4C.

Figure 5B:
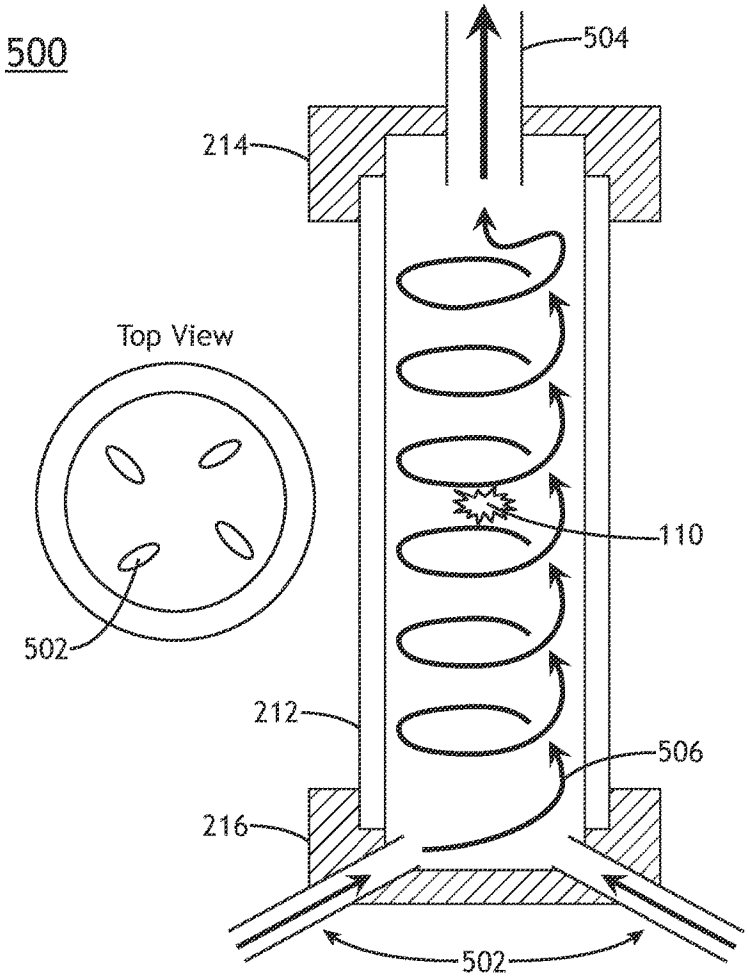
FIGS. 5A and 5B are schematic illustrations of a multiple-inlet vortex-generating gas cell for use in the LSP broadband light source, in accordance with one or more embodiments of the present disclosure.
Figure 5A:
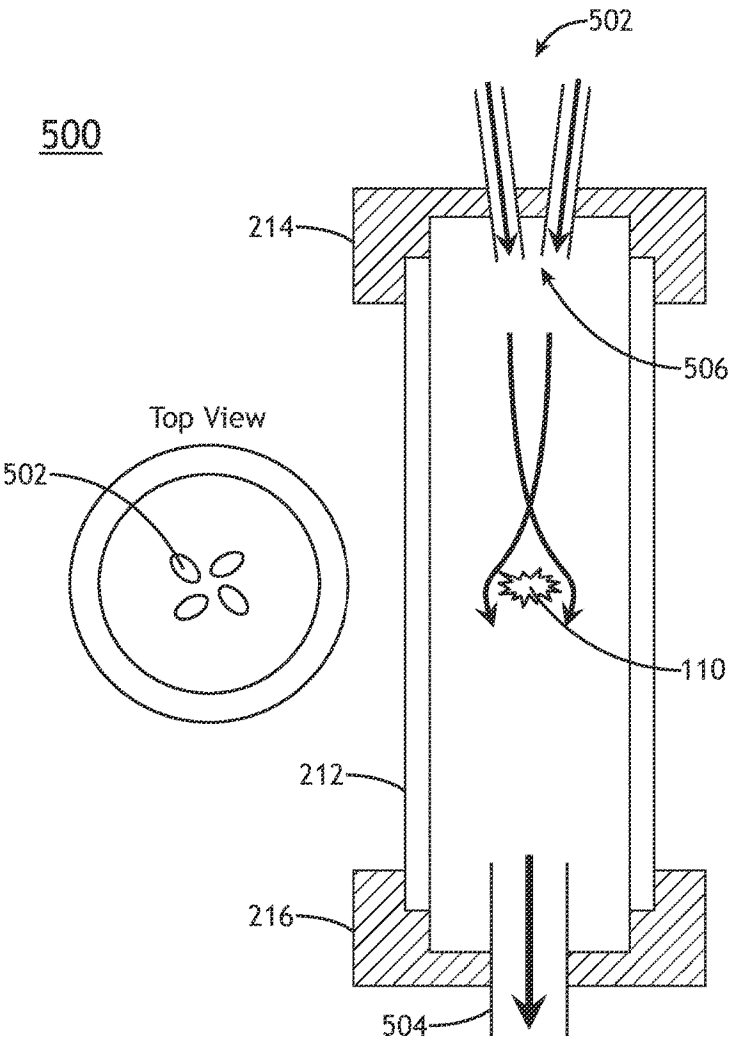

FIG. 5A illustrates a simplified schematic view of a multi-inlet vortex cell 500 suitable for use as the vortex-producing gas containment structure 108, in accordance with one or more embodiments of the present disclosure. In this embodiment, multiple centrally-located inlets 502 and an outlet 504 are utilized to create a fast gas flow (e.g., 1-20 m/s) through the plasma-forming region of the vortex cell 500. Due to the central location of the inlets 502 and outlet 504, the gas flow has relatively minimal vorticity. It is noted that the vortex cell 500 may include any number of inlets. For example, as shown in the top view of FIG. 5A, the vortex includes four inlets. The vortex cell 500 may include other numbers of inlets such as, but not limited to, two inlets, three inlets, five inlets and so on. In other embodiments, as shown in FIG. 5B, the multiple inlets 502 are located at a peripheral location (e.g., edge) of the cell 510 and are obliquely oriented into the cell and are utilized to create a fast high-vorticity gas flow (e.g., 1-100 m/s) through the plasma-forming region of the vortex cell 510. Due to the peripheral location of the inlets 502 and the central location of the outlet 504, the gas flow has relatively high vorticity. Positioning inlets about the perimeter of the cell 500 enhances the vorticity within the vortex cell 510.

Figure 5C:
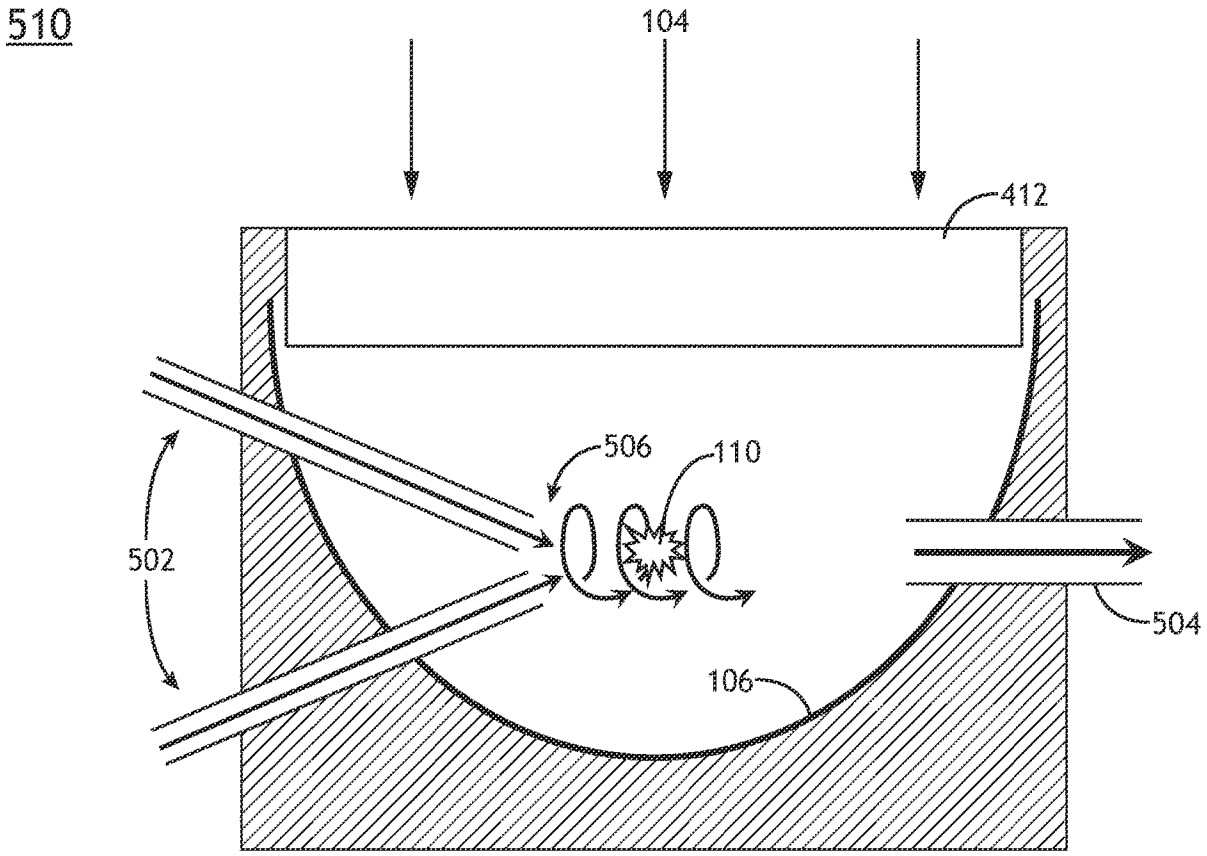
FIG. 5C is a schematic illustration of a multiple-inlet vortex-generating gas chamber for use in the LSP broadband light source, in accordance with one or more embodiments of the present disclosure.

In another embodiment, as shown in FIG. 5C, multiple inlets 502 may be implemented within a plasma chamber 510. The inlets 502 may be positioned anywhere along the light collector element 106 and their relative position may be utilized to establish the necessary vorticity within the plasma chamber 510. It is noted that any nozzle configuration of the present disclosure, as discussed further herein, may be used in the inlets of FIGS. 5A-5C.

Any number of peripheral or centered inlet sets may be utilized within the cells or chambers of the present disclosure. The inlets and outlets and the rate of flow through them are to be configured depending on the desired flow regime. For example, to establish reversed vortex flow the main outlets may be centrally-located on the same side of the cell as the main inlets. Additional inlets and outlets can be located on the opposite side of the cell/chamber to achieve desired flow regime.

Figure 6:
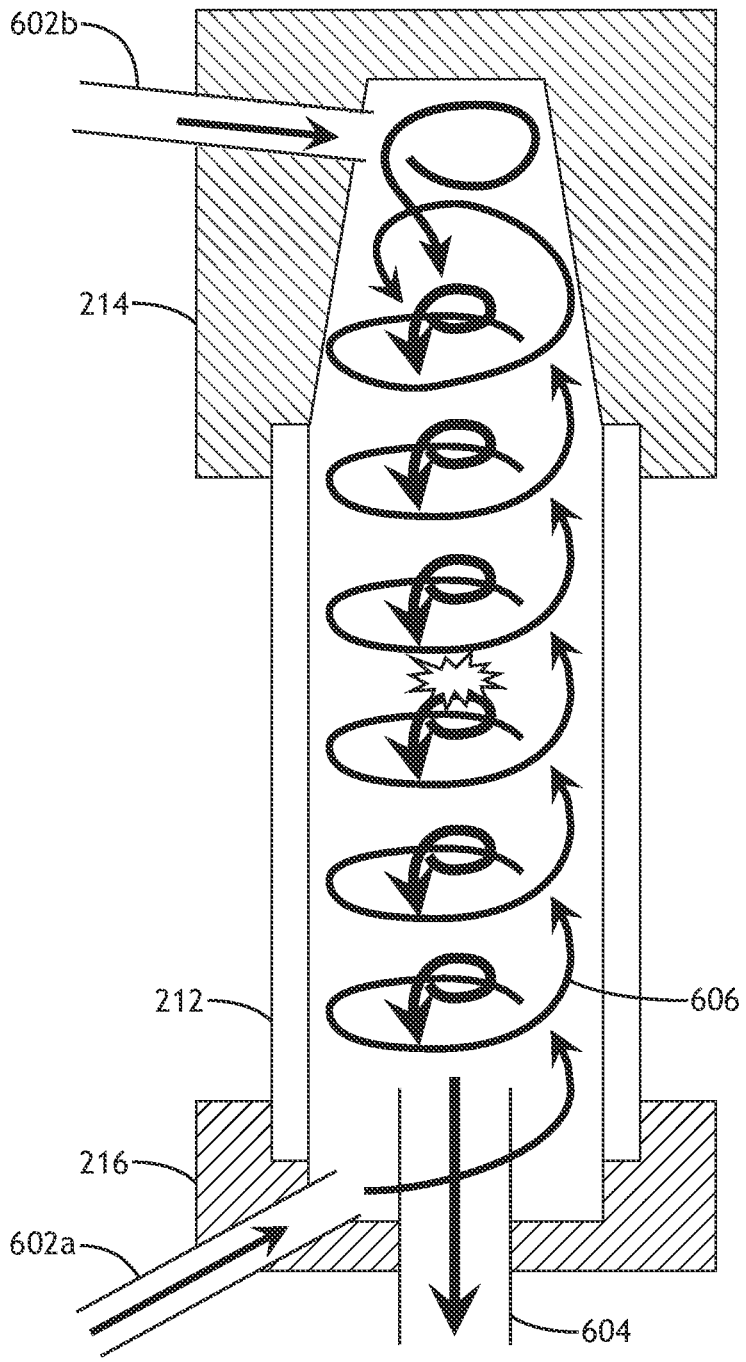
FIG. 6 is a schematic illustration of a reverse-flow vortex-generating gas cell including multiple side-located gas inlets for use in the LSP broadband light source, in accordance with one or more embodiments of the present disclosure.

FIG. 6 illustrates a simplified schematic view of a reverse-flow vortex cell 600 including side-wall positioned gas inlets for use as the gas containment structure 108 of system 100, in accordance with one or more embodiments of the present disclosure. In embodiments, the reverse-flow vortex cell 600 includes a first inlet 602*a* located in a bottom flange 216 and a second inlet 602*b* located in a top flange 214. It is noted that the inlets may be positioned within the end flanges and/or the side wall of the cell 600. The outlet inlet 604 is positioned at the center of the cell 604. The side location of the inlets 602*a*, 602*b* and the central location of the outlet produces significant vorticity within the cell 600. It is noted that while FIG. 6 depicts the inlets 602*a*, 602*b* as being located on the periphery of the cell 600 this arrangement is a not a limitation on the scope of the present disclosure. In an alternative embodiment, one or more outlets may be located at the periphery of the cell 600, with one or more inlets being centrally located at the top or bottom of the cell 600.

Figure 7B:
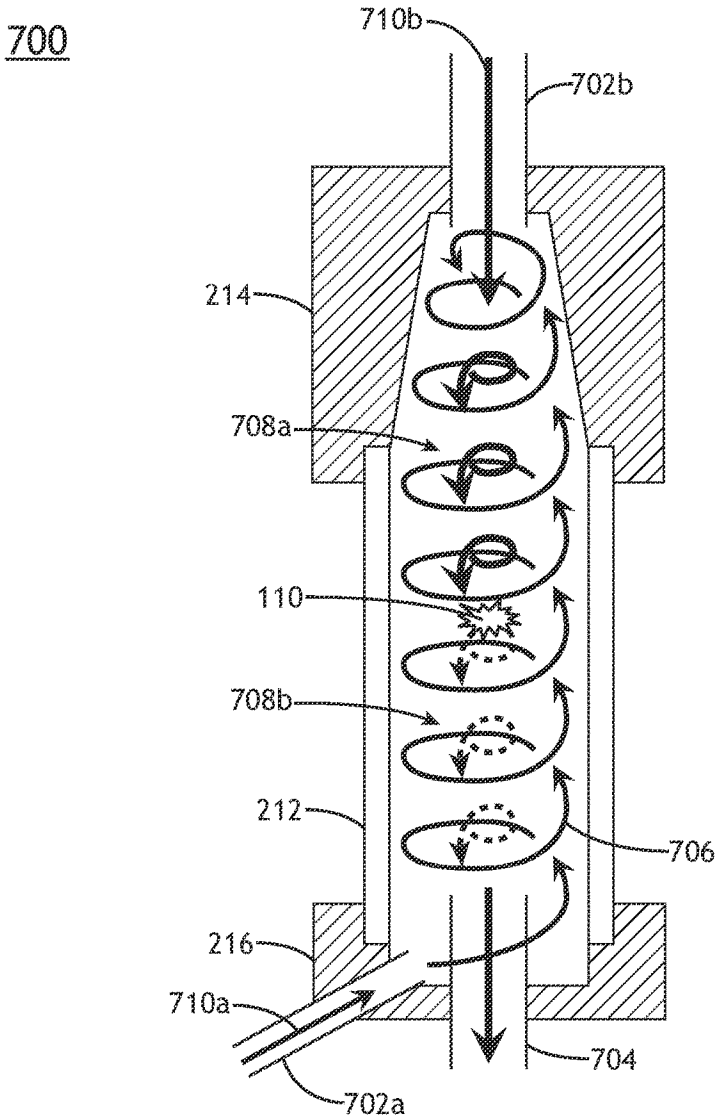
FIGS. 7A and 7B are schematic illustrations of a vortex-generating gas cell including gas inlets for introduction of multiple gases for use in the LSP broadband light source, in accordance with one or more embodiments of the present disclosure.
Figure 7A:
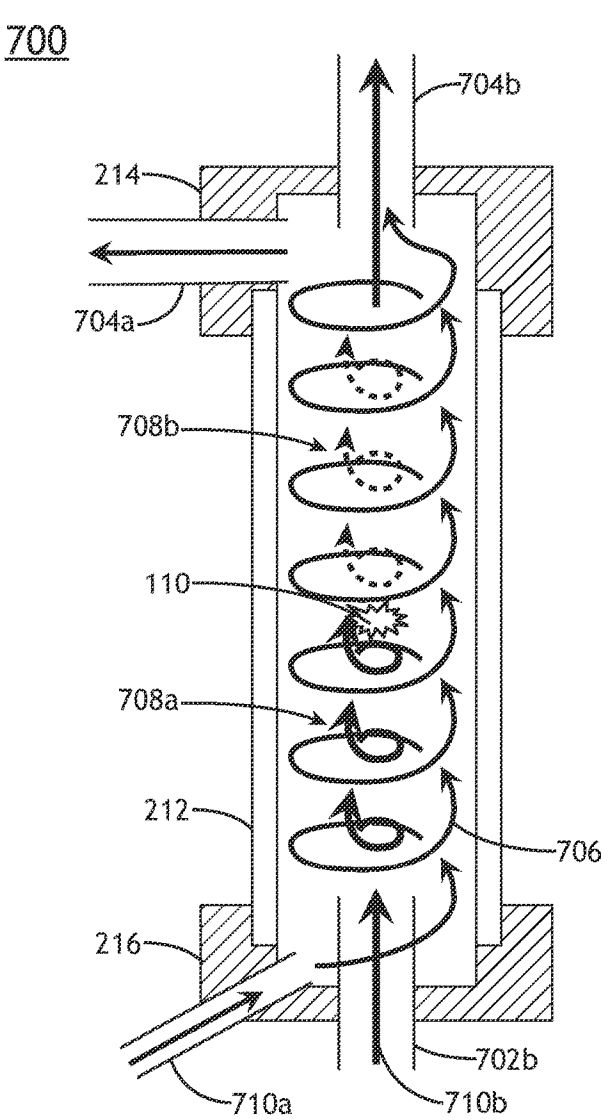

FIGS. 7A and 7B illustrate simplified schematic views of a reverse-flow vortex cell 700 including multiple gas inlets for use as the gas containment structure 108 of system 100, in accordance with one or more embodiments of the present disclosure. In embodiments, each of the inlets can carry a different gas or gas mixture into the cell 700. Referring to FIGS. 7A and 7B, a first gas 710*a* may be introduced into the cell 700 via a first inlet 702*a* and a second gas 710*b* may be introduced into the cell 700 via a second inlet 702*b*. In this regard, the gas composition near the cell wall and near the plasma can be independently controlled. The interior gas region 708*a* is the gas flow being directed into the plasma 110, while the interior gas flow 708*b* is the gas flow carrying away the hot plume of the plasma 110. For example, as shown in FIG. 7A, the first inlet 702*a* and the second inlet 702*b* are arranged in a co-propagating configuration, whereby the first gas and the second gas flow in the same direction through the cell 700. The interior gas flow By way of another example, as shown in FIG. 7B, the first inlet 702*a* and the second inlet 702*b* are arranged in a reverse-propagating configuration, whereby the first gas and the second gas flow in opposite directions through the cell 700.

It is noted that any combination of gases or gas mixtures may be used in the cell 700. For example, the first gas may be pure Ar while, the second gas is Ar with an $O_2$ additive. In this example, the oxygen additive may be used to absorb a portion of Ar plasma radiation that is damaging to the glass wall, thereby creating a beneficial chemical environment near the glass wall. Non-limiting examples of the first gas 710*a*/second gas 710*b* combination are as follows: Xe—Ar; air ($N_2/O_2$)—Ar; Ar/Xe—Ar; Ar/$O_2$—Ar; Ar/Xe/$O_2$—Ar; Ar/Xe/$F_2$—Ar; Ar/$CF_6$—Ar; Ar/$CF_6$—Ar/Xe, and the like.

Figure 8:
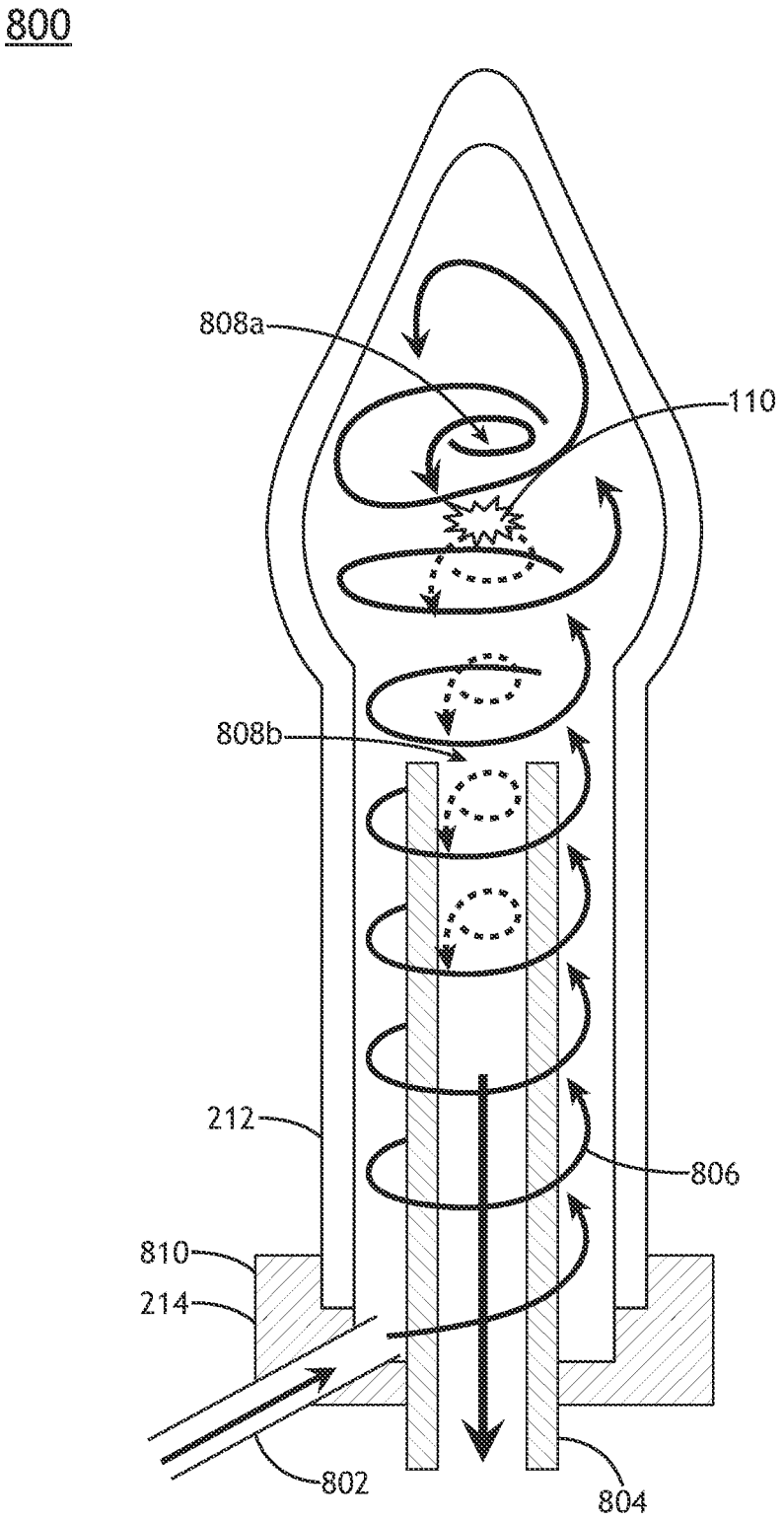
FIG. 8 is a schematic illustration of a vortex-generating glass cell for use in the LSP broadband light source, in accordance with one or more embodiments of the present disclosure.

FIG. 8 illustrates a simplified schematic view of a glass reverse-flow vortex cell 800 for use as the gas containment structure 108 of system 100, in accordance with one or more embodiments of the present disclosure. The cell 800 includes a gas inlet 802 and a gas outlet 804 positioned on the same side of the cell 800 (e.g., bottom flange 810). In embodiments, the cell 800 is formed from glass (e.g., blown glass). In embodiments, the cell 800 is formed from a transparent glass (e.g., fused silica) body that is sealed to a metal flange 810 used for inlets and outlets and cooling of the metal parts that may be needed to control the gas flow 806. The internal gas flow 808*a* is directed downward toward the plasma 110 and the internal gas flow 808*b* carries away the hot plume of the plasma 110. It is noted that an advantage for the use of such cells compared to traditional lamps is that the convective plume originating at the LSP 110 is carried by the internal vortex gas flow 808*b* and does not contact the glass wall thus reducing the heat load on the glass wall of the cell 800. Fabricating flow-through cells out of glass allows for a variety of shapes accessible through standard glass shaping techniques. These shapes may help convection and also help reducing optical aberrations for the laser pump and collected light.

Figure 9A:
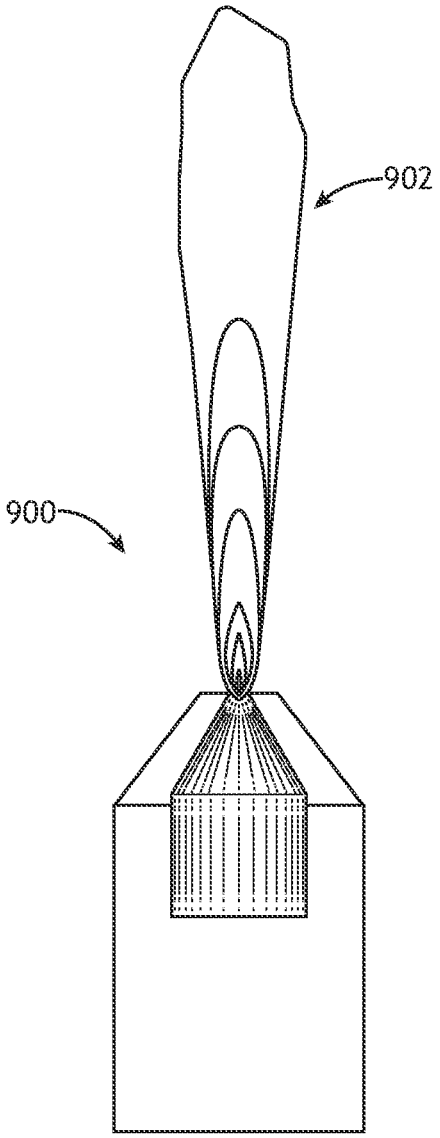
FIG. 9A is a schematic illustration of a converging nozzle for use in an inlet of a vortex-producing cell of the LSP broadband light source, in accordance with one or more embodiments of the present disclosure.
Figure 9B:
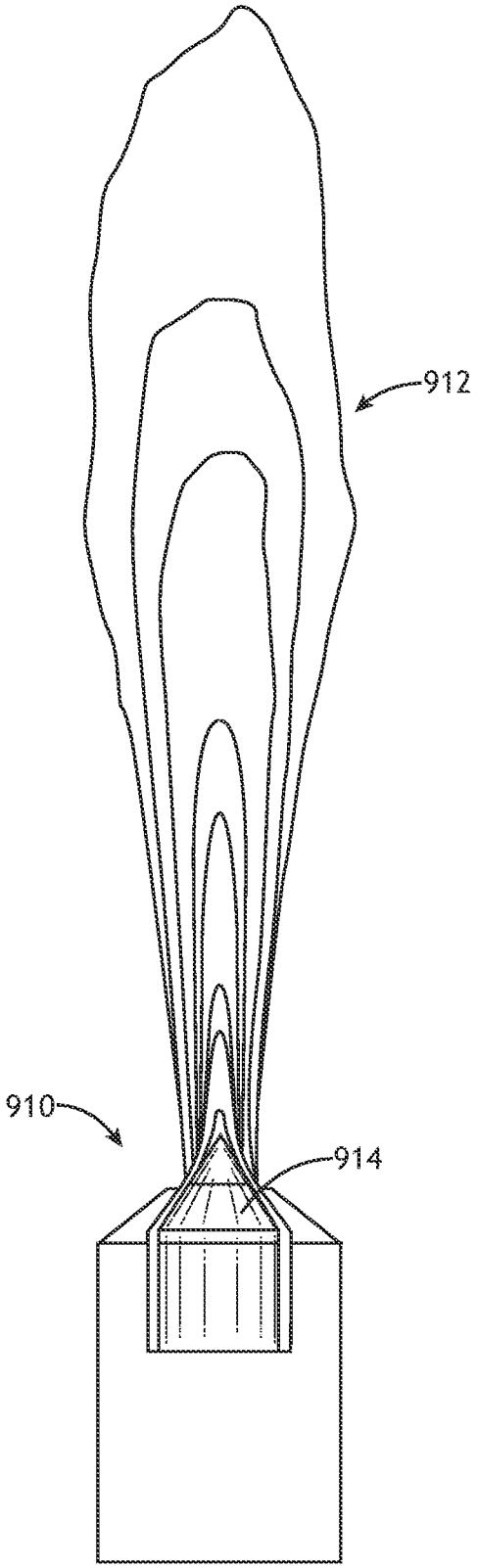
FIG. 9B is a schematic illustration of an annular flow nozzle for use in an inlet of a vortex-producing cell of the LSP broadband light source, in accordance with one or more embodiments of the present disclosure.

FIGS. 9A and 9B illustrate schematic views of nozzles suitable for use in one or more of the inlets the cells of the present disclosure. In embodiments, as shown in FIG. 9A, a converging nozzle 900 may be used in one or more inlets of the various cells of the system 100. In other embodiments, as shown in FIG. 9B, an annular flow nozzle 910 may be used in one or more inlets of the various cells of the system 100. The annular flow nozzle 910 may include a flow guiding nose 914. The utilization of the annular flow nozzle 910 allows for the placement of the LSP 110 at a sufficient distance from the nozzle to avoid overheating of components. As shown in FIGS. 9A and 9B, the flow stream 912 of the annular flow nozzle 910 is significantly extended relative to the flow stream 902 of the converging nozzle 900. The flow stream of the annular flow nozzle 910 is created by adding a flow guiding nose near the bottom-end of a pressurized cell. The additional pressure head required to create flow velocities of interest is quite insignificant as compared to operating pressures for these cases. The flow velocities decay rapidly for a converging jet. However, by using an annular flow inlet and guiding the flow along a converging nose, the flow velocities can be sustained at much farther distances. In this configuration, the plasma can be ignited at a farther and safer distance from flow guide. In addition, the nozzles can be water cooled and run at safe operating temperatures without melting concerns.

Figure 10:
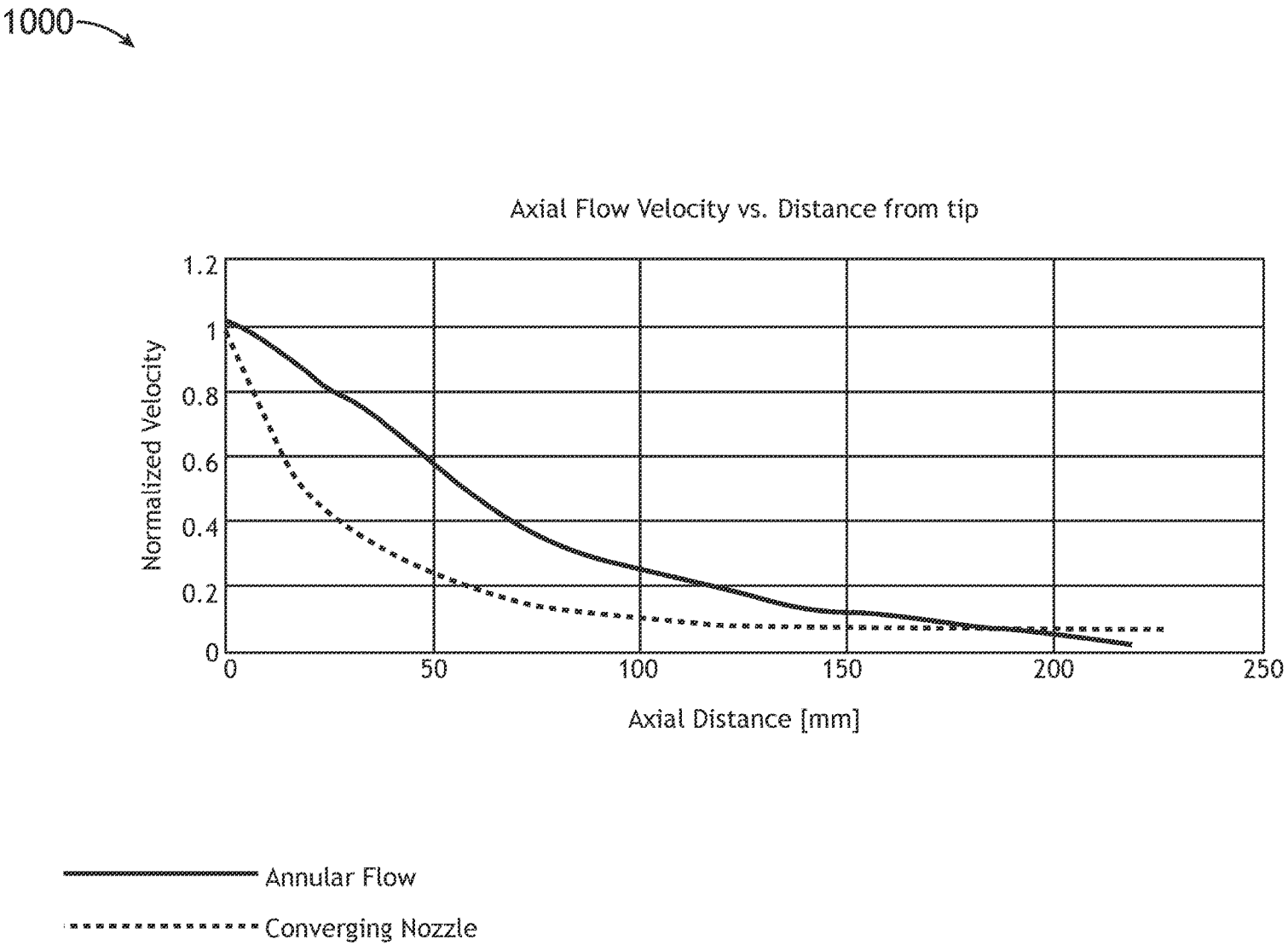
FIG. 10 depicts a comparison line plot comparing gas flow velocity of the annular flow nozzle to the gas flow velocity of the converging nozzle as a function of axial distance from the nozzles.

FIG. 10 depicts a comparison line plot indicating that a plasma can be ignited at ~50 mm away from nose guide and still retain a flow velocity>50% of tip velocity for the flow guided nose configuration of the annular flow nozzle 910. It is noted that the converging nozzle 900 and/or the annular flow nozzle 910 may be implemented within any of the gas inlets of the vortex or reverse-flow vortex cells discussed throughout the preset disclosure.

Figure 11B:
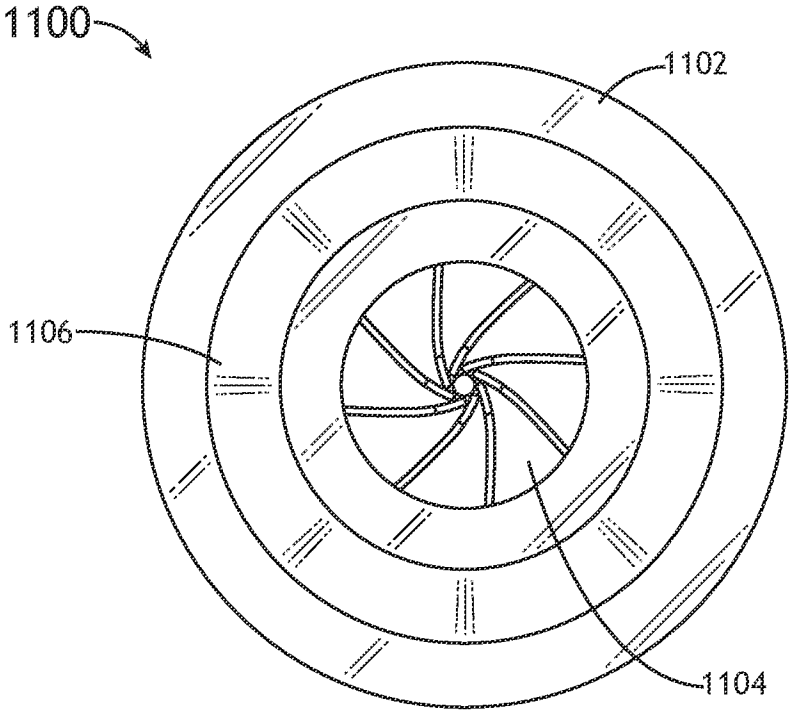
FIGS. 11A and 11B are schematic illustrations of a multiple annular flow nozzle, in accordance with one or more embodiments of the present disclosure.
Figure 11A:
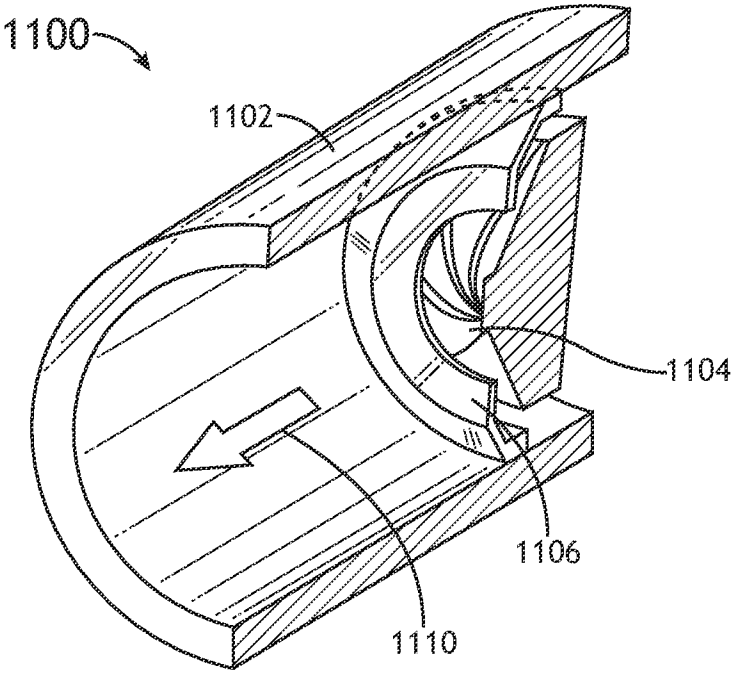

FIGS. 11A and 11B illustrate schematic views of an annular nozzle arrangement including multiple jets, in accordance with one or more embodiments of the present disclosure. FIG. 11A depicts a cross-section of an annular flow nozzle with multiple jets, while FIG. 11B depicts a top view of the annular flow nozzle with multiple jets. In embodiments, the annular flow nozzle 1100 includes a nozzle head 1106 located within an inlet channel 1102. In embodiments, multiple outflow jets 1104 are spiraled around the underlying conical guide 1108, resulting in an outgoing vortex flow patten in the outgoing gas 1110. It is noted that the multiple jeet annular flow nozzle 1100 may be implemented within any of the gas inlets of the vortex or reverse-flow vortex cells discussed throughout the preset disclosure.

Referring generally to FIGS. 1-11B, the pump source 102 may include any laser system known in the art capable of serving as an optical pump for sustaining a plasma. For instance, the pump source 102 may include any laser system known in the art capable of emitting radiation in the infrared, visible and/or ultraviolet portions of the electromagnetic spectrum.

In embodiments, the pump source 102 may include a laser system configured to emit continuous wave (CW) laser radiation. For example, the pump source 102 may include one or more CW infrared laser sources. In embodiments, the pump source 102 may include one or more lasers configured to provide laser light at substantially a constant power to the plasma 110. In embodiments, the pump source 102 may include one or more modulated lasers configured to provide modulated laser light to the plasma 110. In embodiments, the pump source 102 may include one or more pulsed lasers configured to provide pulsed laser light to the plasma. In embodiments, the pump source 102 may include one or more diode lasers. For example, the pump source 102 may include one or more diode lasers emitting radiation at a wavelength corresponding with any one or more absorption lines of the species of the gas contained within the gas containment structure. A diode laser of pump source 102 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas used in the light source 100. In embodiments, the pump source 102 may include an ion laser. For example, the pump source 102 may include any noble gas ion laser known in the art. For instance, in the case of an argon-based plasma, the pump source 102 used to pump argon ions may include an Ar+ laser. In embodiments, the pump source 102 may include one or more frequency converted laser systems. In embodiments, the pump source 102 may include a disk laser. In embodiments, the pump source 102 may include a fiber laser. In embodiments, the pump source 102 may include a broadband laser. In embodiments, the pump source 102 may include one or more non-laser sources. The pump source 102 may include any non-laser light source known in the art. For instance, the pump source 102 may include any non-laser system known in the art capable of emitting radiation discretely or continuously in the infrared, visible or ultraviolet portions of the electromagnetic spectrum.

In embodiments, the pump source 102 may include two or more light sources. In embodiments, the pump source 102 may include two or more lasers. For example, the pump source 102 (or "sources") may include multiple diode lasers. In embodiments, each of the two or more lasers may emit laser radiation tuned to a different absorption line of the gas or plasma within source 100.

The light collector element 106 may include any light collector element known in the art of plasma production. For example, the light collector element 106 may include one or more elliptical reflectors, one or more spherical reflectors, and/or one or more parabolic reflectors. The light collector element 106 may be configured to collect any wavelength of broadband light from the plasma 110 known in the art of plasma-based broadband light sources. For example, the light collector element 106 may be configured to collect infrared light, visible light, ultraviolet (UV) light, near ultraviolet (NUV), vacuum UV (VUV) light, and/or deep UV (DUV) light from the plasma 110.

The transmitting portion of the gas containment structure of source 100 (e.g., transmission element, bulb or window) may be formed from any material known in the art that is at least partially transparent to the broadband light 115 generated by plasma 110 and/or the pump light 104. In embodiments, one or more transmitting portions of the gas containment structure (e.g., transmission element, bulb or window) may be formed from any material known in the art that is at least partially transparent to VUV radiation, DUV radiation, UV radiation, NUV radiation and/or visible light generated within the gas containment structure. Further, one or more transmitting portions of the gas containment structure may be formed from any material known in the art that is at least partially transparent to IR radiation, visible light and/or UV light from the pump source 102. In embodiments, one or more transmitting portions of the gas containment structure may be formed from any material known in the art transparent to both radiation from the pump source 102 (e.g., IR source) and radiation (e.g., VUV, DUV, UV, NUV radiation and/or visible light) emitted by the plasma 110.

The gas containment structure 108 may contain any selected gas (e.g., argon, xenon, mercury or the like) known in the art suitable for generating a plasma upon absorption of pump illumination. In embodiments, the focusing of pump illumination 510 from the pump source 102 into the volume of gas causes energy to be absorbed by the gas or plasma (e.g., through one or more selected absorption lines) within the gas containment structure, thereby "pumping" the gas species in order to generate and/or sustain a plasma 110. In embodiments, although not shown, the gas containment structure may include a set of electrodes for initiating the plasma 110 within the internal volume of the gas containment structure 108, whereby the illumination from the pump source 102 maintains the plasma 110 after ignition by the electrodes.

The source 100 may be utilized to initiate and/or sustain the plasma 110 in a variety of gas environments. In embodiments, the gas used to initiate and/or maintain plasma 110 may include an inert gas (e.g., noble gas or non-noble gas) or a non-inert gas (e.g., mercury). In embodiments, the gas used to initiate and/or maintain a plasma 110 may include a mixture of gases (e.g., mixture of inert gases, mixture of inert gas with non-inert gas or a mixture of non-inert gases). For example, gases suitable for implementation in source 100 may include, but are not limited, to Xe, Ar, Ne, Kr, He, $N_2$, $H_2O$, $O_2$, $H_2$, $D_2$, $F_2$, $CH_4$, $CF_6$ one or more metal halides, a halogen, Hg, Cd, Zn, Sn, Ga, Fe, Li, Na, Ar:Xe, ArHg, KrHg, XeHg, and any mixture thereof. The present disclosure should be interpreted to extend to any gas suitable for sustaining a plasma within a gas containment structure.

In embodiments, the LSP light source 100 further includes one or more additional optics configured to direct the broadband light 115 from the plasma 110 to one or more downstream applications. The one or more additional optics may include any optical element known in the art including, but not limited to, one or more mirrors, one or more lenses, one or more filters, one or more beam splitters, or the like. The light collector element 106 may collect one or more of visible, NUV, UV, DUV, and/or VUV radiation emitted by plasma 110 and direct the broadband light 115 to one or more downstream optical elements. For example, the light collector element 106 may deliver infrared, visible, NUV, UV, DUV, and/or VUV radiation to downstream optical elements of any optical characterization system known in the art, such as, but not limited to, an inspection tool, a metrology tool, or a lithography tool. In this regard, the broadband light 115 may be coupled to the illumination optics of an inspection tool, metrology tool, or lithography tool.

Figure 12:
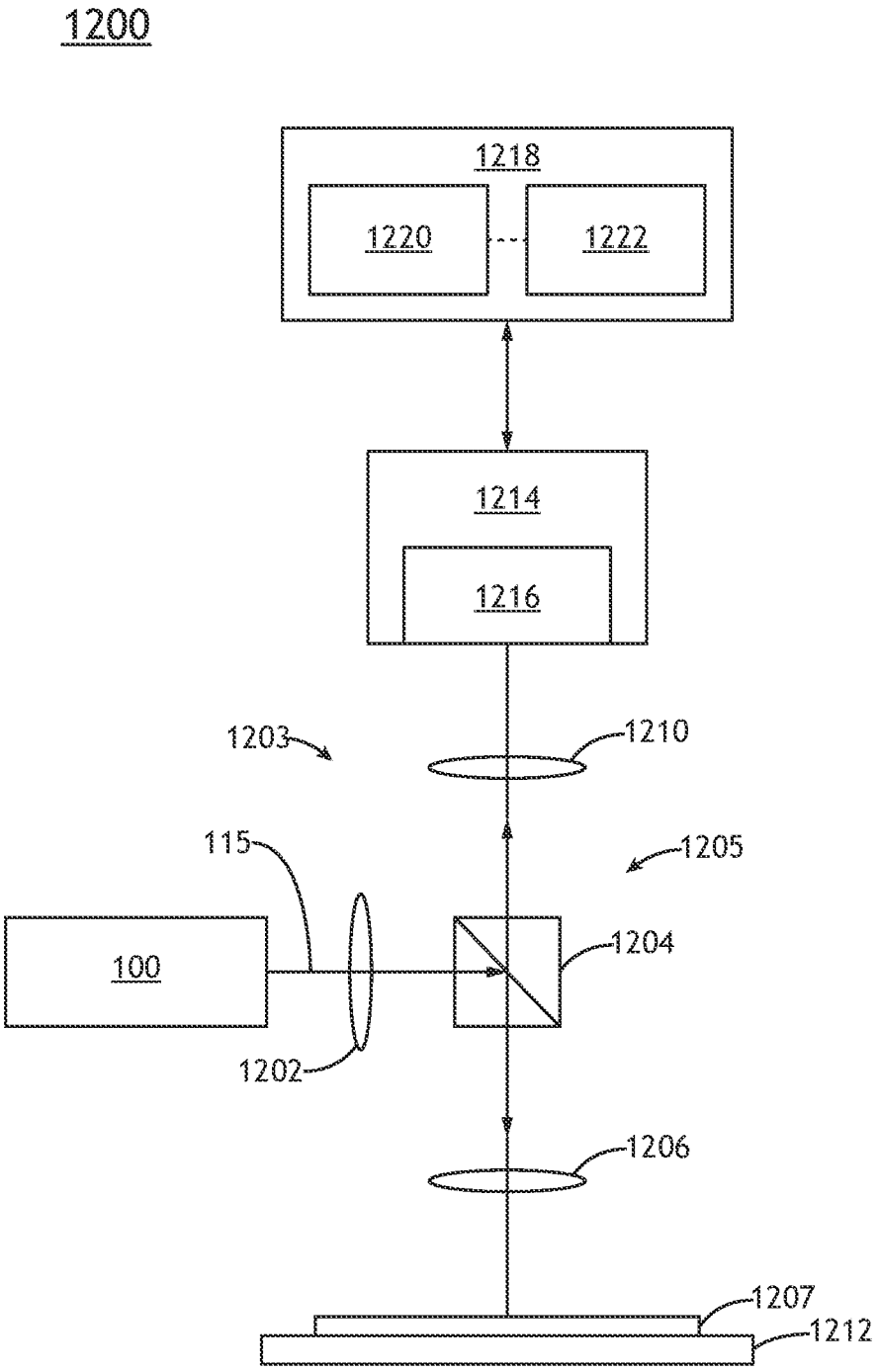
FIG. 12 is a simplified schematic illustration of an optical characterization system implementing an the LSP broadband light source illustrated in any of FIGS. 5A through 5C, in accordance with one or more embodiments of the present disclosure.

FIG. 12 is a schematic illustration of an optical characterization system 1200 implementing the LSP broadband light source 100 illustrated in any of FIG. 11 through (or any combination thereof), in accordance with one or more embodiments of the present disclosure.

It is noted herein that system 1200 may comprise any imaging, inspection, metrology, lithography, or other characterization/fabrication system known in the art. In this regard, system 1200 may be configured to perform inspection, optical metrology, lithography, and/or imaging on a sample 1207. Sample 1207 may include any sample known in the art including, but not limited to, a wafer, a reticle/photomask, and the like. It is noted that system 1200 may incorporate one or more of the various embodiments of the LSP broadband light source 100 described throughout the present disclosure.

In embodiments, sample 1207 is disposed on a stage assembly 1212 to facilitate movement of sample 1207. The stage assembly 1212 may include any stage assembly 1212 known in the art including, but not limited to, an X-Y stage, an R-θ stage, and the like. In embodiments, stage assembly 1212 is capable of adjusting the height of sample 1207 during inspection or imaging to maintain focus on the sample 1207.

In embodiments, the set of illumination optics 1203 is configured to direct illumination from the broadband light source 100 to the sample 1207. The set of illumination optics 1203 may include any number and type of optical components known in the art. In embodiments, the set of illumination optics 1203 includes one or more optical elements such as, but not limited to, one or more lenses 1202, a beam splitter 1204, and an objective lens 1206. In this regard, set of illumination optics 1203 may be configured to focus illumination from the LSP broadband light source 100 onto the surface of the sample 1207. The one or more optical elements may include any optical element or combination of optical elements known in the art including, but not limited to, one or more mirrors, one or more lenses, one or more polarizers, one or more gratings, one or more filters, one or more beam splitters, and the like.

In embodiments, the set of collection optics 1205 is configured to collect light reflected, scattered, diffracted, and/or emitted from sample 1207. In embodiments, the set of collection optics 1205, such as, but not limited to, focusing lens 710, may direct and/or focus the light from the sample 1207 to a sensor 1216 of a detector assembly 1214. It is noted that sensor 1216 and detector assembly 1214 may include any sensor and detector assembly known in the art. For example, the sensor 1216 may include, but is not limited to, a charge-coupled device (CCD) detector, a complementary metal-oxide semiconductor (CMOS) detector, a time-delay integration (TDI) detector, a photomultiplier tube (PMT), an avalanche photodiode (APD), and the like. Further, sensor 1216 may include, but is not limited to, a line sensor or an electron-bombarded line sensor.

In embodiments, detector assembly 1214 is communicatively coupled to a controller 1218 including one or more processors 1220 and memory medium 1222. For example, the one or more processors 1220 may be communicatively coupled to memory 1222, wherein the one or more processors 1220 are configured to execute a set of program instructions stored on memory 1222. In embodiments, the one or more processors 1220 are configured to analyze the output of detector assembly 1214. In embodiments, the set of program instructions are configured to cause the one or more processors 1220 to analyze one or more characteristics of sample 1207. In embodiments, the set of program instructions are configured to cause the one or more processors 1220 to modify one or more characteristics of system 1200 in order to maintain focus on the sample 1207 and/or the sensor 1216. For example, the one or more processors 1220 may be configured to adjust the objective lens 1206 or one or more optical elements 1202 in order to focus illumination from LSP broadband light source 100 onto the surface of the sample 1207. By way of another example, the one or more processors 1220 may be configured to adjust the objective lens 1206 and/or one or more optical elements 1202 in order to collect illumination from the surface of the sample 1207 and focus the collected illumination on the sensor 1216.

It is noted that the system 1200 may be configured in any optical configuration known in the art including, but not limited to, a dark-field configuration, a bright-field orientation, and the like.

Figure 13:
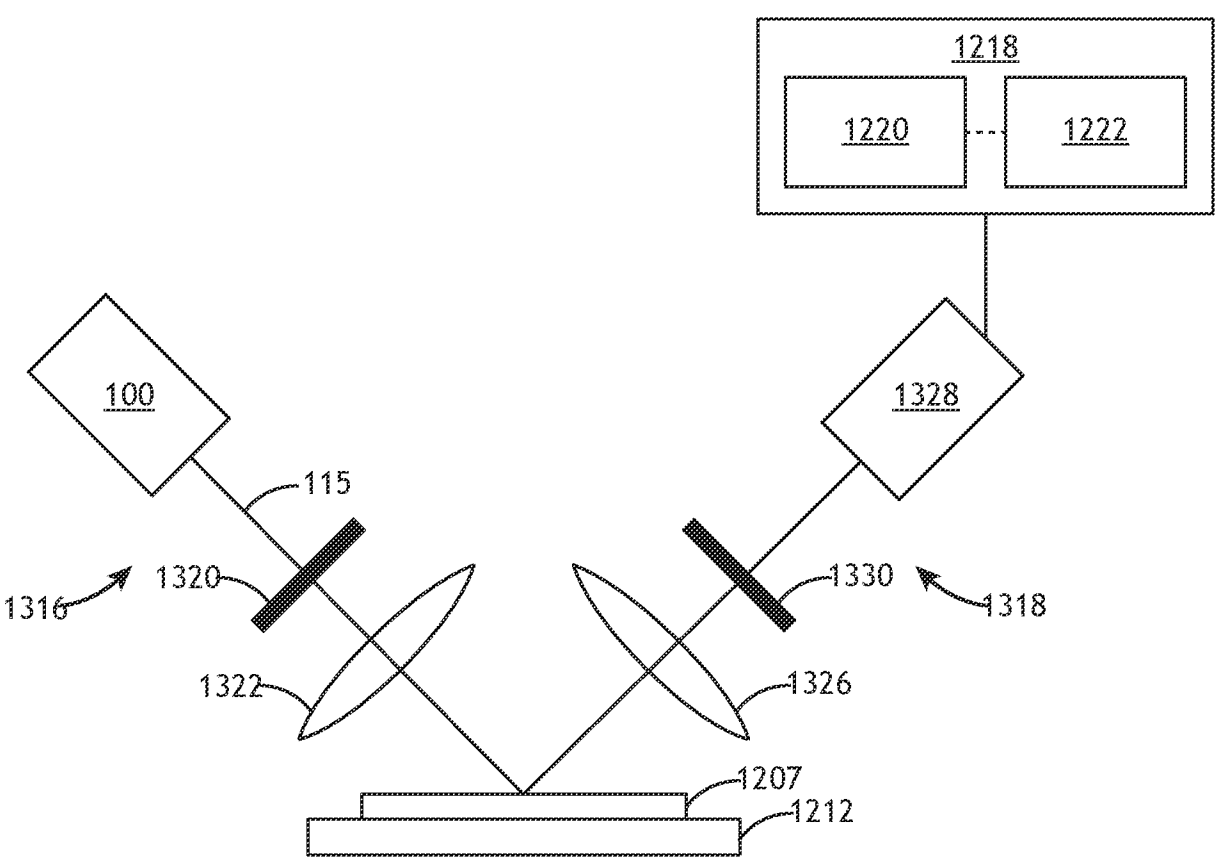
FIG. 13 illustrates a simplified schematic diagram of an optical characterization system arranged in a reflectometry and/or ellipsometry configuration, in accordance with one or more embodiments of the present disclosure

FIG. 13 illustrates a simplified schematic diagram of an optical characterization system 1300 arranged in a reflectometry and/or ellipsometry configuration, in accordance with one or more embodiments of the present disclosure. It is noted that the various embodiments and components described with respect to FIGS. 1 through 12 may be interpreted to extend to the system of FIG. 13. The system 1300 may include any type of metrology system known in the art.

In embodiments, system 1300 includes the LSP broadband light source 100, a set of illumination optics 1316, a set of collection optics 1318, a detector assembly 1328, and the controller 1218 including the one or more processors 1220 and memory 1222.

In this embodiment, the broadband illumination from the LSP broadband light source 100 is directed to the sample 1207 via the set of illumination optics 1316. In embodiments, the system 1300 collects illumination emanating from the sample via the set of collection optics 1318. The set of illumination optics 1316 may include one or more beam conditioning components 1320 suitable for modifying and/or conditioning the broadband beam. For example, the one or more beam conditioning components 1320 may include, but are not limited to, one or more polarizers, one or more filters, one or more beam splitters, one or more diffusers, one or more homogenizers, one or more apodizers, one or more beam shapers, or one or more lenses.

In embodiments, the set of illumination optics 1316 may utilize a first focusing element 1322 to focus and/or direct the beam onto the sample 207 disposed on the sample stage 1312. In embodiments, the set of collection optics 1318 may include a second focusing element 1326 to collect illumination from the sample 1207.

In embodiments, the detector assembly 1328 is configured to capture illumination emanating from the sample 1207 through the set of collection optics 1318. For example, the detector assembly 1328 may receive illumination reflected or scattered (e.g., via specular reflection, diffuse reflection, and the like) from the sample 1207. By way of another example, the detector assembly 1328 may receive illumination generated by the sample 1207 (e.g., luminescence associated with absorption of the beam, and the like). It is noted that detector assembly 1328 may include any sensor and detector assembly known in the art. For example, the sensor may include, but is not limited to, CCD detector, a CMOS detector, a TDI detector, a PMT, an APD, and the like.

The set of collection optics 1318 may further include any number of collection beam conditioning elements 1330 to direct and/or modify illumination collected by the second focusing element 1326 including, but not limited to, one or more lenses, one or more filters, one or more polarizers, or one or more phase plates.

The system 1300 may be configured as any type of metrology tool known in the art such as, but not limited to, a spectroscopic ellipsometer with one or more angles of illumination, a spectroscopic ellipsometer for measuring Mueller matrix elements (e.g., using rotating compensators), a single-wavelength ellipsometer, an angle-resolved ellipsometer (e.g., a beam-profile ellipsometer), a spectroscopic reflectometer, a single-wavelength reflectometer, an angle-resolved reflectometer (e.g., a beam-profile reflectometer), an imaging system, a pupil imaging system, a spectral imaging system, or a scatterometer.

A description of an inspection/metrology tools suitable for implementation in the various embodiments of the present disclosure are provided in U.S. Pat. No. 7,957,066, entitled "Split Field Inspection System Using Small Catadioptric Objectives," issued on Jun. 7, 2011; U.S. Pat. No. 7,345,825, entitled "Beam Delivery System for Laser Dark-Field Illumination in a Catadioptric Optical System," issued on Mar. 18, 2018; U.S. Pat. No. 5,999,310, entitled "Ultra-broadband UV Microscope Imaging System with Wide Range Zoom Capability," issued on Dec. 7, 1999; U.S. Pat. No. 7,525,649, entitled "Surface Inspection System Using Laser Line Illumination with Two Dimensional Imaging," issued on Apr. 28, 2009; U.S. Pat. No. 9,228,943, entitled "Dynamically Adjustable Semiconductor Metrology System," issued on Jan. 5, 2016; U.S. Pat. No. 5,608,526, entitled "Focused Beam Spectroscopic Ellipsometry Method and System, by Piwonka-Corle et al., issued on Mar. 4, 1997; and U.S. Pat. No. 6,297,880, entitled "Apparatus for Analyzing Multi-Layer Thin Film Stacks on Semiconductors," issued on Oct. 2, 2001, which are each incorporated herein by reference in their entirety.

The one or more processors 1220 of a controller 1218 may include any processor or processing element known in the art. For the purposes of the present disclosure, the term "processor" or "processing element" may be broadly defined to encompass any device having one or more processing or logic elements (e.g., one or more micro-processor devices, one or more application specific integrated circuit (ASIC) devices, one or more field programmable gate arrays (FPGAs), or one or more digital signal processors (DSPs)). In this sense, the one or more processors 1220 may include any device configured to execute algorithms and/or instructions (e.g., program instructions stored in memory) from a memory medium 1222. The memory medium 1222 may include any storage medium known in the art suitable for storing program instructions executable by the associated one or more processors 1220.

In embodiments, the LSP light source 100 and systems 1200, 1300, as described herein, may be configured as a "stand alone tool," interpreted herein as a tool that is not physically coupled to a process tool. In other embodiments, such an inspection or metrology system may be coupled to a process tool (not shown) by a transmission medium, which may include wired and/or wireless portions. The process tool may include any process tool known in the art such as a lithography tool, an etch tool, a deposition tool, a polishing tool, a plating tool, a cleaning tool, or an ion implantation tool. The results of inspection or measurement performed by the systems described herein may be used to alter a parameter of a process or a process tool using a feedback control technique, a feedforward control technique, and/or an in-situ control technique. The parameter of the process or the process tool may be altered manually or automatically.

One skilled in the art will recognize that the herein described components operations, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, operations, devices, and objects should not be taken as limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A laser-sustained plasma light source comprising:

a gas containment structure for containing a gas;

one or more gas inlets fluidically coupled to the gas containment structure and configured to flow the gas into the gas containment structure;

one or more gas outlets fluidically coupled to the gas containment structure and configured to flow gas out of the gas containment structure, wherein the one or more gas inlets and the one or more gas outlets are arranged to generate a vortex gas flow within the gas containment structure;

a laser pump source configured to generate an optical pump to sustain a plasma in a region of the gas containment structure within an inner gas flow within the vortex gas flow; and a light collector element configured to collect at least a portion of broadband light emitted from the plasma.

2. The laser-sustained source of claim 1, wherein the vortex flow comprises a helical vortex flow with a drift velocity between 1 and 100 m/s.

3. The laser-sustained source of claim 1, wherein the one or more gas inlets comprise at least a first gas inlet and wherein the one or more gas outlets comprise at least a first gas outlet.

4. The laser-sustained source of claim 3, wherein the one or more gas inlets comprise a first gas inlet and a second gas inlet and wherein the one or more gas outlets comprise a first gas outlet and a second gas outlet.

5. The laser-sustained source of claim 1, wherein the one or more gas inlets are positioned on a side of the gas containment structure opposite from the one or more gas outlets.

6. The laser-sustained source of claim 5, wherein the vortex gas flow direction through the plasma region is in same direction of an inlet gas flow from the one or more inlets.

7. The laser-sustained source of claim 1, wherein the one or more gas inlets are positioned on the same side of the gas containment structure as the one or more gas outlets.

8. The laser-sustained source of claim 7, wherein the vortex gas flow direction through the plasma region is in an opposite direction of an inlet gas flow from the one or more inlets.

9. The laser-sustained light source of claim 1, where one or more of the gas inlets are positioned at a peripheral portion of the gas containment structure and one or more of the gas outlets are positioned at a center portion of the gas containment structure.

10. The laser-sustained light source of claim 1, where one or more of the gas outlets are positioned at a peripheral portion of the gas containment structure and one or more of the gas inlets are positioned at a center portion of the gas containment structure.

11. The laser-sustained light source of claim 1, where one or more of the gas inlets are positioned at a peripheral portion of the gas containment structure and one or more of the gas outlets are positioned at an additional peripheral portion of the gas containment structure.

12. The laser-sustained light source of claim 1, wherein the one or more gas inlets include a gas nozzle for flowing gas through the gas containment structure.

13. The laser-sustained light source of claim 12, wherein the gas nozzle comprises a converging gas nozzle for generating a gas jet.

14. The laser-sustained light source of claim 12, wherein the gas nozzle comprises an annular flow nozzle for generating an annular gas jet having a gas velocity sufficient to maintain a plasma 25-75 mm from the annular flow nozzle.

15. The laser-sustained light source of claim 14, wherein the annular flow nozzle comprises a flow guiding nose section.

16. The laser-sustained light source of claim 1, wherein a gas flow from the one or more inlets and a gas flow into one or more outlets are propagating in the same direction.

17. The laser-sustained light source of claim 1, wherein a gas flow from the one or more inlets and a gas flow into one or more outlets are propagating in opposite directions.

18. The laser-sustained light source of claim 1, wherein the gas containment structure comprises at least one of a plasma cell, a plasma bulb, or a plasma chamber.

19. The laser-sustained light source of claim 1, wherein the gas contained within the gas containment structure comprises at least one Xe, Ar, Ne, Kr, He $N_2$, $H_2O$, $O_2$, $H_2$, $D_2$, $F_2$, $CF_6$, or a mixture of two or more Xe, Ar, Ne, Kr, He, $N_2$, $H_2O$, $O_2$, $H_2$, $D_2$, $F_2$, or $CF_6$.

20. The laser-sustained light source of claim 1, wherein the light collector element comprises an elliptical, parabolical, or spherical light collector element.

21. The laser-sustained light source of claim 1, wherein the pump source comprises:

one or more lasers.

22. The laser-sustained light source of claim 21, wherein the pump source comprises:

at least one of an infrared laser, a visible laser, or an ultraviolet laser.

23. The laser-sustained light source of claim 1, wherein the light collector element is configured to collect at least one of broadband infrared, visible, UV, VUV, or DUV light from the plasma.

24. The laser-sustained light source of claim 1, further comprising: one or more additional collection optics configured to direct a broadband light output from the plasma to one or more downstream applications.

25. The laser-sustained light source of claim 24, wherein the one or more downstream applications comprises at least one of inspection or metrology.

26. A characterization system comprising:

a laser-sustained light source comprising:

a gas containment structure for containing a gas;

one or more gas inlets fluidically coupled to the gas containment structure and configured to flow the gas into the gas containment structure;

one or more gas outlets fluidically coupled to the gas containment structure and configured to flow gas out of the gas containment structure, wherein the one or more gas inlets and the one or more gas outlets are arranged to generate a vortex gas flow within the gas containment structure;

a laser pump source configured to generate an optical pump to sustain a plasma in a region of the gas containment structure within an inner gas flow within the vortex gas flow; and a light collector element configured to collect at least a portion of broadband light emitted from the plasma;

a set of illumination optics configured to direct broadband light from the laser-sustained light source to one or more samples;

a set of collection optics configured to collect light emanating from the one or more samples; and a detector assembly.

27. A plasma cell comprising:

a gas containment structure for containing a gas;

one or more gas inlets fluidically coupled to the gas containment structure and configured to flow the gas into the gas containment structure;

one or more gas outlets fluidically coupled to the gas containment structure and configured to flow gas out of the gas containment structure, wherein the one or more gas inlets and the one or more gas outlets are arranged to generate a vortex gas flow within the gas containment structure, wherein the vortex gas flow direction through the plasma region is in the same direction of an inlet gas flow from the one or more inlets, wherein the gas containment structure is configured to receive an optical pump to sustain a plasma within an inner gas flow within the vortex gas flow.

28. A plasma cell comprising:

a gas containment structure for containing a gas;

one or more gas inlets fluidically coupled to the gas containment structure and configured to flow the gas into the gas containment structure;

one or more gas outlets fluidically coupled to the gas containment structure and configured to flow gas out of the gas containment structure, wherein the one or more gas inlets and the one or more gas outlets are arranged to generate a vortex gas flow within the gas containment structure, wherein the vortex gas flow direction through the plasma region is in an opposite direction of an inlet gas flow from the one or more inlets, wherein the gas containment structure is configured to receive an optical pump to sustain a plasma within an inner gas flow within the vortex gas flow.

29. A method comprising:

generating a vortex gas flow within a gas containment structure of a laser-sustained light source;

generating pump illumination;

directing, with a light collector element, a portion of the pump illumination into an inner gas flow within the vortex gas flow in the gas containment structure to sustain a plasma; and collecting a portion of broadband light emitted from the plasma with the light collector element and directing the portion of broadband light to one or more downstream applications.

* * * * *